US011315457B2

(12) United States Patent
Kwon et al.

(10) Patent No.: US 11,315,457 B2
(45) Date of Patent: Apr. 26, 2022

(54) DISPLAY DEVICE

(71) Applicant: Samsung Display Co., Ltd., Yongin-Si (KR)

(72) Inventors: Sangan Kwon, Cheonan-si (KR); Jinoh Kwag, Yongin-si (KR); Soon-Dong Kim, Osan-si (KR); Taehoon Kim, Hwaseong-si (KR); Hui Nam, Suwon-si (KR); Bonghyun You, Seoul (KR); Eun Sil Yun, Hwaseong-si (KR); Changnoh Yoon, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/231,388

(22) Filed: Apr. 15, 2021

(65) Prior Publication Data

US 2022/0020303 A1 Jan. 20, 2022

(30) Foreign Application Priority Data

Jul. 14, 2020 (KR) ..... 10-2020-0086576

(51) Int. Cl.
*G09G 3/00* (2006.01)
*G09G 3/3275* (2016.01)
(Continued)

(52) U.S. Cl.
CPC ..... *G09G 3/035* (2020.08); *G09G 3/3266* (2013.01); *G09G 3/3275* (2013.01); *G09G 5/14* (2013.01);
(Continued)

(58) Field of Classification Search
CPC .... G06F 1/1652; G06F 1/1641; G06F 1/1616; G06F 3/04166; G09F 9/301;
(Continued)

(56) References Cited

U.S. PATENT DOCUMENTS 10,262,580 B2 4/2019 Chang
10,338,727 B2 7/2019 Yu et al.
(Continued)

FOREIGN PATENT DOCUMENTS

KR 1020150106371 A 9/2015
KR 101693088 B1 1/2017
KR 1020190058995 A 5/2019

*Primary Examiner* — Koosha Sharifi-Tafreshi
(74) *Attorney, Agent, or Firm* — Cantor Colburn LLP

(57) ABSTRACT

A display device includes a driving controller which provides a first start signal and a second start signal corresponding to an operation mode to a scan driving circuit. The scan driving circuit includes a first scan driving circuit having first dummy driving stages and first driving stages which sequentially drive scan lines corresponding to a first display region among a plurality of scan lines in synchronization with the first start signal and a second scan driving circuit having second dummy driving stages and second driving stages which sequentially drive scan lines corresponding to a second display region among the plurality of scan lines in synchronization with the second start signal. The first dummy driving stages are disposed on a first side surface of the display panel and the second dummy driving stages are disposed on a second side surface of the display panel.

20 Claims, 18 Drawing Sheets

(51) Int. Cl.
*G09G 3/3266* (2016.01)
*G09G 5/14* (2006.01)
*G09G 3/3233* (2016.01)

(52) U.S. Cl.
CPC ... *G09G 3/3233* (2013.01); *G09G 2310/0213* (2013.01); *G09G 2310/08* (2013.01)

(58) Field of Classification Search
CPC ..... H01L 2251/5338; H01L 51/0097; H04M 1/0268; G09G 2380/02; G09G 3/035; G09G 2310/0286; G09G 2310/0267; G09G 3/3266; G09G 3/3674; G09G 2310/0283; G02F 1/133305
See application file for complete search history.

(56) References Cited

U.S. PATENT DOCUMENTS

| | | | | |
|---|---|---|---|---|
| 10,656,743 | B2 | 5/2020 | Park et al. | |
| 2018/0122302 | A1* | 5/2018 | Koong | G09G 3/3233 |
| 2018/0197481 | A1* | 7/2018 | Choi | G09G 3/3266 |

* cited by examiner

DISPLAY DEVICE

This application claims priority to Korean Patent Application No. 10-2020-0086576, filed on Jul. 14, 2020, and all the benefits accruing therefrom under 35 U.S.C. § 119, the content of which in its entirety is herein incorporated by reference.

BACKGROUND

Field

The present disclosure relates to a display device, and more specifically, to a display device capable of multi-frequency driving.

Discussion of the Background

Among display devices, an organic light emitting display device displays an image using an organic light emitting diode which generates light by recombination of electrons and holes. Such an organic light emitting display device has advantages of having fast response speed and being driven with low power consumption.

The organic light emitting display device is provided with pixels connected to data lines and scan lines. The pixels usually include an organic light emitting diode and a circuit unit for controlling the amount of current flowing into the organic light emitting diode. The circuit unit controls the amount of current flowing from a first driving voltage to a second driving voltage via the organic light emitting diode in correspondence to a data signal. At this time, in correspondence to the amount of the current flowing through the organic light emitting diode, light with a predetermined luminance is generated.

A display device is used in various fields. Therefore, a plurality of different types of images may be displayed on a single display device. In addition, there are researches for a technology to reduce power consumption of the display device on which a plurality of images is displayed.

SUMMARY

The present disclosure also provides a display device capable of reducing power consumption.

An embodiment of the inventive concept provides a display device including a display panel in which a first display region and a second display region are defined and including a plurality of pixels each connected to one of a plurality of data lines and at least one of a plurality of scan lines, a data driving circuit which drives the plurality of data lines, a scan driving circuit which drives the plurality of scan lines, and a driving controller which receives an image signal and a control signal and control the data driving circuit and the scan driving circuit according to an operation mode. In an embodiment, the driving controller provides a first start signal and a second start signal corresponding to the operation mode to the scan driving circuit. The scan driving circuit includes a first scan driving circuit having first dummy driving stages and first driving stages which sequentially drive scan lines corresponding to the first display region among the plurality of scan lines in synchronization with the first start signal and a second scan driving circuit having second dummy driving stages and second driving stages which sequentially drive scan lines corresponding to the second display region among the plurality of scan lines in synchronization with the second start signal, where the first dummy driving stages are disposed on a first side surface of the display panel and the second dummy driving stages are disposed on a second side surface of the display panel.

In an embodiment, the plurality of scan lines may include first to n-th first scan lines, the first display region may correspond to from the first first scan line to the k-th first scan line among the plurality of scan lines, the second display region may correspond to from the (k+1)-th first scan line to the n-th first scan line among the plurality of scan lines, and n may be a natural number and k may be a natural number less than n.

In an embodiment, the first scan driving circuit may sequentially drive from the first first scan line to the k-th first scan line, and the second scan driving circuit may sequentially drive from the n-th first scan line to the (k+1)-th first scan line.

In an embodiment, the plurality of scan lines may further include first to n-th second scan lines, where the first dummy driving stages may include first to w-th first dummy driving stages, the first to w-th first dummy driving stages may sequentially drive from the first first scan line to the w(wherein, w is a natural number)-th first scan line, respectively, and the first driving stages may include first to k-th first driving stages, the first to (k−w)-th first driving stages may sequentially drive from the (w+1)-th first scan line to the k-th first scan line, and the first to k-th first driving stages may sequentially drive from the first second scan line to the k-th second scan line, respectively.

In an embodiment, each of the first dummy driving stages and the first to (k−w)-th first driving stages may output a first scan signal and a dummy-second scan signal in response to a clock signal and a carry signal received from the driving controller.

In an embodiment, the dummy-second scan signal output from the j(wherein, j is a natural number)-th first dummy driving stage may be provided as the carry signal of the (j+1)-th first dummy driving stage, and the second scan signal output from the j-th first driving stage may be provided as the carry signal of the (j+1)-th first driving stage.

In an embodiment, the first first dummy driving stage may receive the first start signal as the carry signal, and the first first driving stage may receive the dummy-second scan signal from the w-th first dummy driving stage as the carry signal.

In an embodiment, the second dummy driving stages may include first to w-th second dummy driving stages, the first to w-th second dummy driving stages may sequentially drive from the n-th first scan line to the (n−w−1)-th first scan line, respectively, and the second driving stages may include (k+1)-th to n-th second driving stages, the n-th to (k+w+1)-th second driving stages may sequentially drive from the (n−w)-th first scan line to the (k+1)-th first scan line, respectively, and the n-th to (k+1)-th second driving stages may sequentially drive from the n-th second scan line to the (k+1)-th second scan line, respectively.

In an embodiment, each of the second dummy driving stages and the n-th to (k+w+1)-th second driving stages may output a first scan signal and a dummy-second scan signal in response to a clock signal and a carry signal received from the driving controller.

In an embodiment, the dummy-second scan signal output from the j(wherein, j is a natural number)-th second dummy driving stage may be provided as the carry signal of the (j+1)-th second dummy driving stage, and the second scan signal output from the j-th second driving stage may be provided as the carry signal of a (j−1)-th second driving stage.

In an embodiment, the first second dummy driving stage may receive the second start signal as the carry signal, and the n-th second driving stage may receive the dummy-second scan signal from the w-th second dummy driving stage.

In an embodiment, the driving controller may provide an image data signal corresponding to the first display region and the second display region to the data driving circuit in every frame when the operation mode is a normal frequency mode, and the driving controller may provide an image data signal corresponding to the first display region and the second display region to the data driving circuit during a first frame and provide an image data signal corresponding to the first display region, not the second display region, to the data driving circuit during a second frame when the operation mode is a multi-frequency mode.

In an embodiment the driving controller may sequentially provide from a data signal corresponding to the first first scan line to a data signal corresponding to the k-th first scan line to the data driving circuit as the image data signal, and may sequentially provide from a data signal corresponding to the n-th first scan line to a data signal corresponding to the (k+1)-th first scan line to the data driving circuit as the image data signal when the operation mode is the normal frequency mode.

In an embodiment the frequency of each of the first start signal and the second start signal may be a first driving frequency when the operation mode is a normal frequency mode, and the frequency of the first start signal may be the first driving frequency and the frequency of the second start signal may be a second driving frequency which is lower than the first driving frequency while the operation mode is a multi-frequency mode.

In an embodiment of the inventive concept, a display device includes a display panel in which a first non-folding region, a folding region, and a second non-folding region are defined on in a plan view and including a plurality of pixels each connected to one of a plurality of data lines and at least one of a plurality of scan lines, a data driving circuit which drives the plurality of data lines, a scan driving circuit which drives the plurality of scan lines, and a driving controller which receives an image signal and a control signal and control the data driving circuit and the scan driving circuit according to an operation mode. In an embodiment, the driving controller provides a first start signal and a second start signal corresponding to the operation mode to the scan driving circuit. In an embodiment, the scan driving circuit includes a first scan driving circuit having first dummy driving stages which sequentially drive scan lines corresponding to a first display region among the plurality of scan lines in synchronization with the first start signal and having first driving stages and a second scan driving circuit having second dummy driving stages which sequentially drive scan lines corresponding to a second display region among the plurality of scan lines in synchronization with the second start signal and having second driving stages, where the first dummy driving stages is disposed on a first side surface of the display panel and the second dummy driving stages is disposed on a second side surface of the display panel.

In an embodiment, the first non-folding region may correspond to the first display region, the second non-folding regions may correspond to the second display region, and a first portion of the folding region may correspond to the first display region and a second portion of the folding region may correspond to the second display region.

In an embodiment, the plurality of scan lines may include first to n-th first scan lines, the first display region may correspond to from the first first scan line to the k-th first scan line among the plurality of scan lines, the second display region may correspond to from the (k+1)-th scan line to the n-th scan line among the plurality of scan lines, and n is a natural number and k is a natural number less than n.

In an embodiment, the first scan driving circuit may sequentially drive from the first first scan line to the k-th first scan line, and the second scan driving circuit may sequentially drive from the n-th first scan line to the (k+1)-th first scan line.

In an embodiment, the plurality of scan lines may further include first to n-th second scan lines, the first dummy driving stages may include first to w-th first dummy driving stages, the first to w-th first dummy driving stages may sequentially drive from the first first scan line to the w(wherein, w is a natural number)-th first scan line, respectively and the first driving stages may include first to k-th first driving stages, the first to (k−w)-th first driving stages may sequentially drive from a (w+1)-th first scan line to a k-th first scan line, respectively, and the first to k-th first driving stages may sequentially drive from the first second scan line to the k-th second scan line, respectively.

In an embodiment, each of the second dummy driving stages may sequentially drive from an n-th first scan line to a (n−w−1)-th first scan line, and each of the second driving stages may sequentially drive from a (n−w)-th first scan line to a (k+1)-th first scan line and sequentially drives from an n-th second scan line to a (k+1)-th second scan line.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1A:
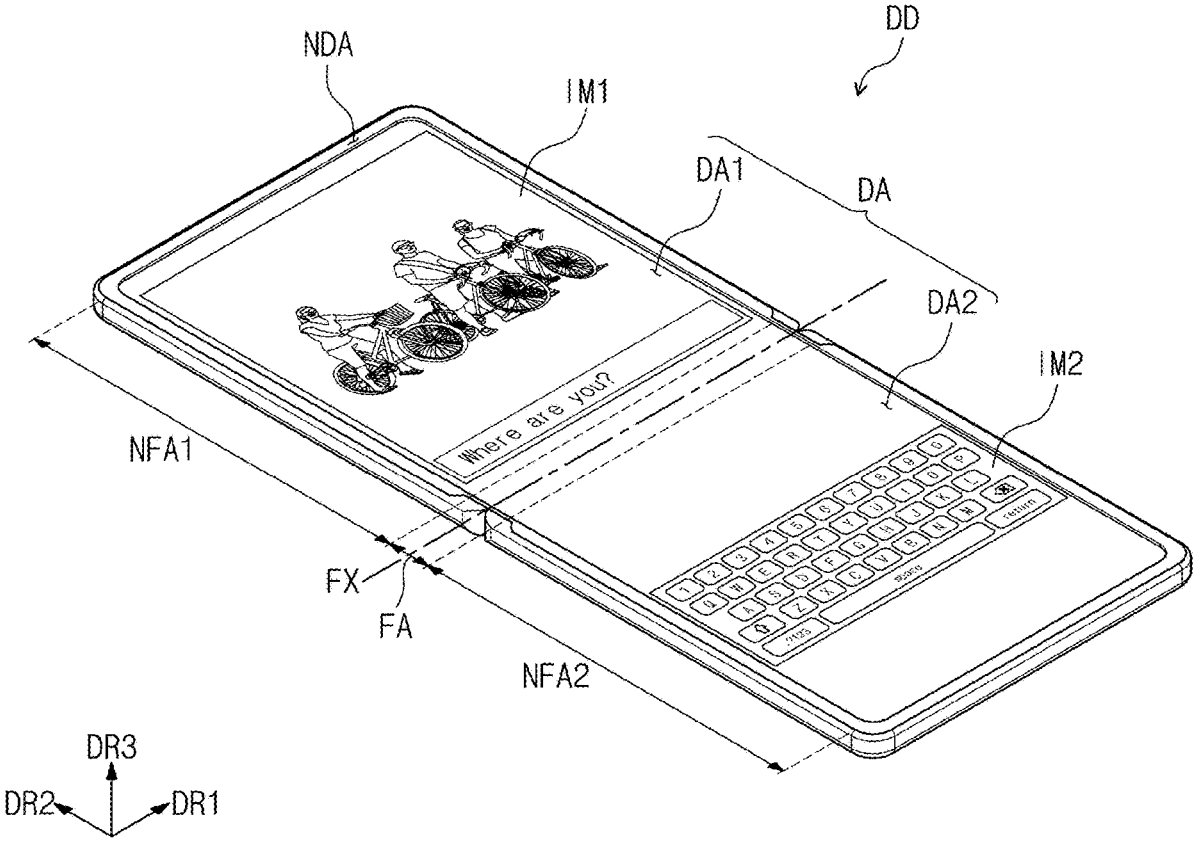
FIG. 1A is a perspective view of a display device according to an embodiment of the inventive concept.

In the present disclosure, when an element (or a region, a layer, a portion, etc.) is referred to as being "on," "connected to," or "coupled to" another element, it means that the element may be directly disposed on/connected to/coupled to the other element, or that a third element may be disposed therebetween.

Like reference numerals refer to like elements. Also, in the drawings, the thickness, the ratio, and the dimensions of elements are exaggerated for an effective description of technical contents. The term "and/or," includes all combinations of one or more of which associated configurations may define.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the inventive concept. The terms of a singular form may include plural forms unless the context clearly indicates otherwise.

In addition, terms such as "below," "lower," "above," "upper," and the like are used to describe the relationship of the configurations shown in the drawings. The terms are used as a relative concept and are described with reference to the direction indicated in the drawings.

It should be understood that the terms "comprise", or "have" are intended to specify the presence of stated features, integers, steps, operations, elements, components, or combinations thereof in the disclosure, but do not preclude the presence or addition of one or more other features, integers, steps, operations, elements, components, or combinations thereof.

Unless otherwise defined, all terms (including technical and scientific terms) used herein have the same meaning as commonly understood by one of ordinary skill in the art to which the inventive concept pertains. It is also to be understood that terms defined in commonly used dictionaries should be interpreted as having meanings consistent with the meanings in the context of the related art, and are expressly defined herein unless they are interpreted in an ideal or overly formal sense.

Hereinafter, exemplary embodiments of the inventive concept will be described with reference to the accompanying drawings.

Figure 1B:
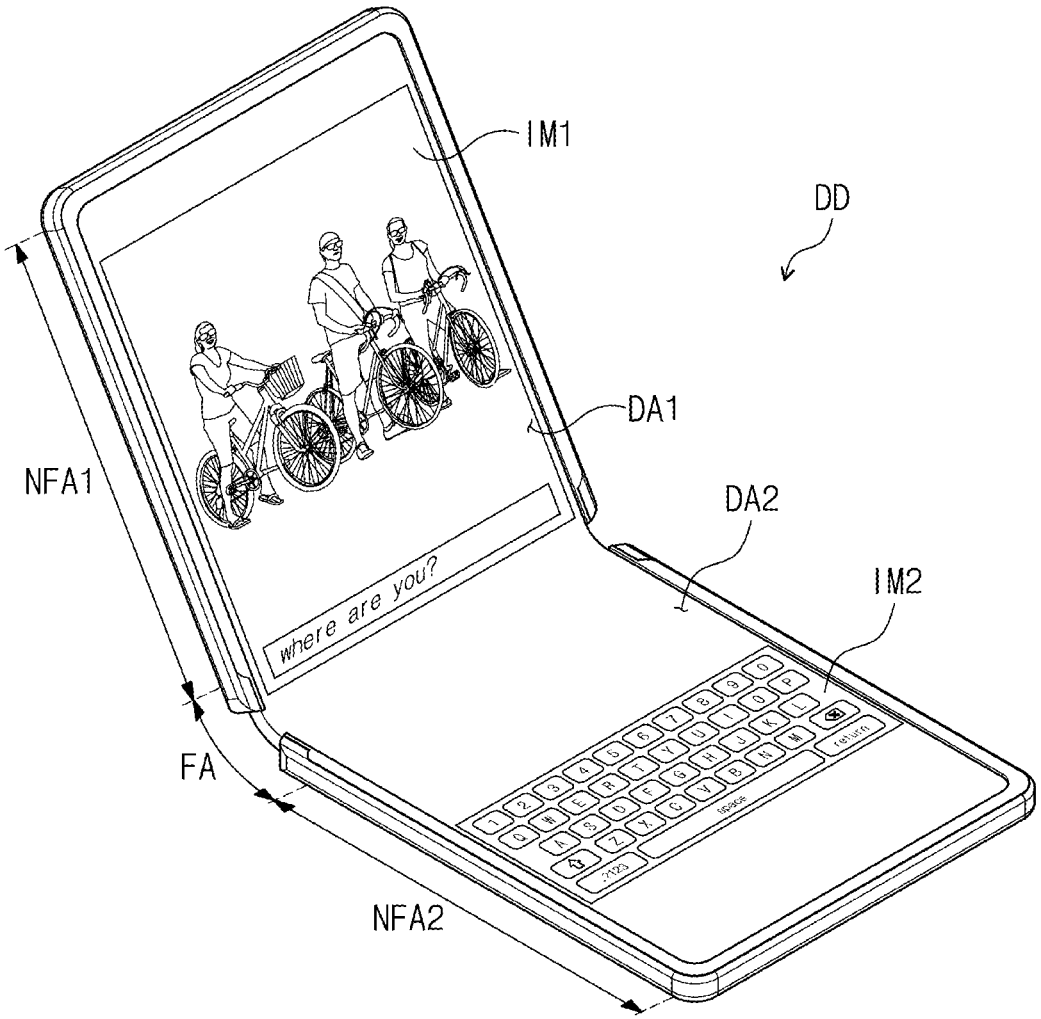
FIG. 1B is a perspective view of a display device according to an embodiment of the inventive concept.

FIG. 1A is a perspective view of a display device according to an embodiment of the inventive concept. FIG. 1B is a perspective view of a display device according to an embodiment of the inventive concept. FIG. 1A illustrates a display device DD in an unfolded state, and FIG. 1B illustrates the display device DD in a folded state.

In FIG. 1A and FIG. 1B, the display device DD is exemplarily illustrated as a mobile phone. However, the embodiment of the inventive concept is not limited thereto. In another embodiment, the display device DD may include a tablet PC, a smart phone, a personal digital assistant ("PDA"), a portable multimedia player ("PMP"), a game console, a wristwatch-type electronic device, or the like. The inventive concept may be used for large-sized electronic devices such as a television or an external advertisement board, and also for small- and medium-sized electronic devices such as a personal computer, a laptop computer, a kiosk, a car navigation system unit, and a camera. It should be understood that these are merely exemplary embodiments and may be employed in other electronic devices without departing from the inventive concept.

The display panel DD includes a display region DA and a non-display region NDA. The display device DD may display an image through the display region DA. When the display device DD is an unfolded state, the display region DA may include a plane defined by a first direction DR1 and a second direction DR2. The thickness direction of the display device DD may be parallel to a third direction DR3 intersecting the first direction DR1 and the second direction DR2. Therefore, a front surface (or an upper surface) and a rear surface (or a lower surface) of members constituting the display device DD may be defined on the basis of the third direction DR3. The non-display region NDA may be referred to as a bezel region. As one example, the display region DA may have a quadrangular shape. The non-display region NDA surrounds the display region DA.

The display region DA may include a first non-folding region NFA1, a folding region FA, and a second non-folding region NFA2. The folding region FA may be bent on the basis of a folding axis FX extending along the first direction DR1.

When the display device DD is folded, the first non-folding region NFA1 and the second non-folding region NFA2 may face each other. Therefore, in a completely folded state, the display region DA may not be exposed to the outside, which may be referred to as "in-folding". However, this is only exemplary. The operation of the display device DD of the inventive concept is not limited thereto.

For example, in another embodiment of the inventive concept, when the display device DD is folded, the first non-folding region NFA1 and the second non-folding region NFA2 may not face each other and face opposite outsides from each other. Therefore, in a folded state, the first non-folding region NFA1 may be exposed to the outside, which may be referred to as "out-folding".

In an embodiment, the display device DD may perform only one operation of in-folding and an out-folding. Alternatively, in another embodiment, the display device DD may perform both an in-folding operation and an out-folding operation. In this case, the same region of the display device DD, for example, the folding region FA may be in-folded and out-folded. Alternatively, in still another embodiment, some portions of the display device DD may be in-folded, and the other regions thereof may be out-folded.

In FIG. 1A and FIG. 1B, one folding region and two non-folding regions are exemplarily illustrated. However, the number of folding regions and non-folding regions of the inventive concept is not limited thereto. In another embodiment, for example, the display device DD may include a plurality of non-folding regions, which is more than two, and a plurality of folding regions disposed between non-folding regions adjacent to each other.

In FIG. 1A and FIG. 1B, the folding axis FX is exemplarily illustrated as being parallel to a short axis (i.e., latitudinal axis) of the display device DD parallel to the first direction DR1, but the inventive concept is not limited thereto. In another embodiment, for example, the folding axis FX may extend along a long axis (i.e., longitudinal axis) of the display device DD, for example, a direction parallel to the second direction DR2. In this case, the first non-folding region NFA1, the folding region FA, and the second non-folding region NFA2 may be sequentially arranged along the first direction DR1.

In the display region DA of the display device DD, a plurality of display regions DA1 and DA2 may be defined. In FIG. 1A, two display regions DA1 and DA2 are exemplarily illustrated. However, the number of the plurality of display regions DA1 and DA2 of the inventive concept is not limited thereto.

The plurality of display regions DA1 and DA2 may include a first display region DA1 and a second display region DA2. For example, the first display region DA1 may be a region in which a first image IM1 is displayed, and the second display region DA2 may be a region in which a second image IM2 is displayed. However, the embodiment of the inventive concept is not limited thereto. For example, the first image IM1 may be a moving image, and the second image IM2 may be a still image or an image (text information, etc.) which does not change for a relatively long period compared to the moving image.

The display device DD according to an embodiment may operate differently according to an operation mode. The operation mode may include a normal frequency mode and a multi-frequency mode. In the normal frequency mode, the display device DD may drive both the first display region DA1 and the second display region DA2 at a normal frequency. In the multi-frequency mode, the display device DD according to an embodiment may drive the first display region DA1 in which the first image IM1 is displayed at a first driving frequency and may drive the second display region DA2 in which the second image IM2 is displayed at a second driving frequency which is lower than the normal frequency. In an embodiment, the first driving frequency may be the same as the normal frequency.

The size of each of the first display region DA1 and the second display region DA2 may be predetermined, and may be changed by an application program. In an embodiment, the first display region DA1 may correspond to the first non-folding region NFA1 and the second display region DA2 may correspond to the second non-folding region NFA2. In addition, a first portion of the folding region FA may correspond to the first display region DA1 and a second portion of the folding region FA may correspond to the second display region DA2.

In another embodiment, the folding region FA may all correspond to either the first display region DA1 or the second display region DA2.

In another embodiment, the first display region DA1 may correspond to a first portion of the first non-folding region NFA1 and the second display region DA2 may correspond to a second portion of the first non-folding region NFA1, the folding region FA, and the second non-folding region NFA2. That is, the area of the first display region DA1 may be smaller than the area of the second display region DA2.

In still another embodiment, the first display region DA1 may correspond to the first non-folding region NFA1, the folding region FA, and a first portion of the second non-folding region NFA2, and the second display region DA2 may correspond to a second portion of the second non-folding region NFA2. That is, the area of the second display region DA2 may be smaller than the area of the first display region DA1.

As illustrated in FIG. 1B, when the folding region FA is in a folded state (i.e., intermediately folded state), the first display region DA1 may correspond to the first non-folding region NFA1 and the second display region DA2 may correspond to the second non-folding region NFA2.

In FIG. 1A and FIG. 2B, a foldable display device DD is illustrated as an example of a display device. However, the embodiment of the inventive concept is not limited thereto. In another embodiment, for example, the inventive concept may be applied to an unfoldable display device, a display device having two or more folding regions, a rollable display device, a slidable display device, or the like.

Figure 2:
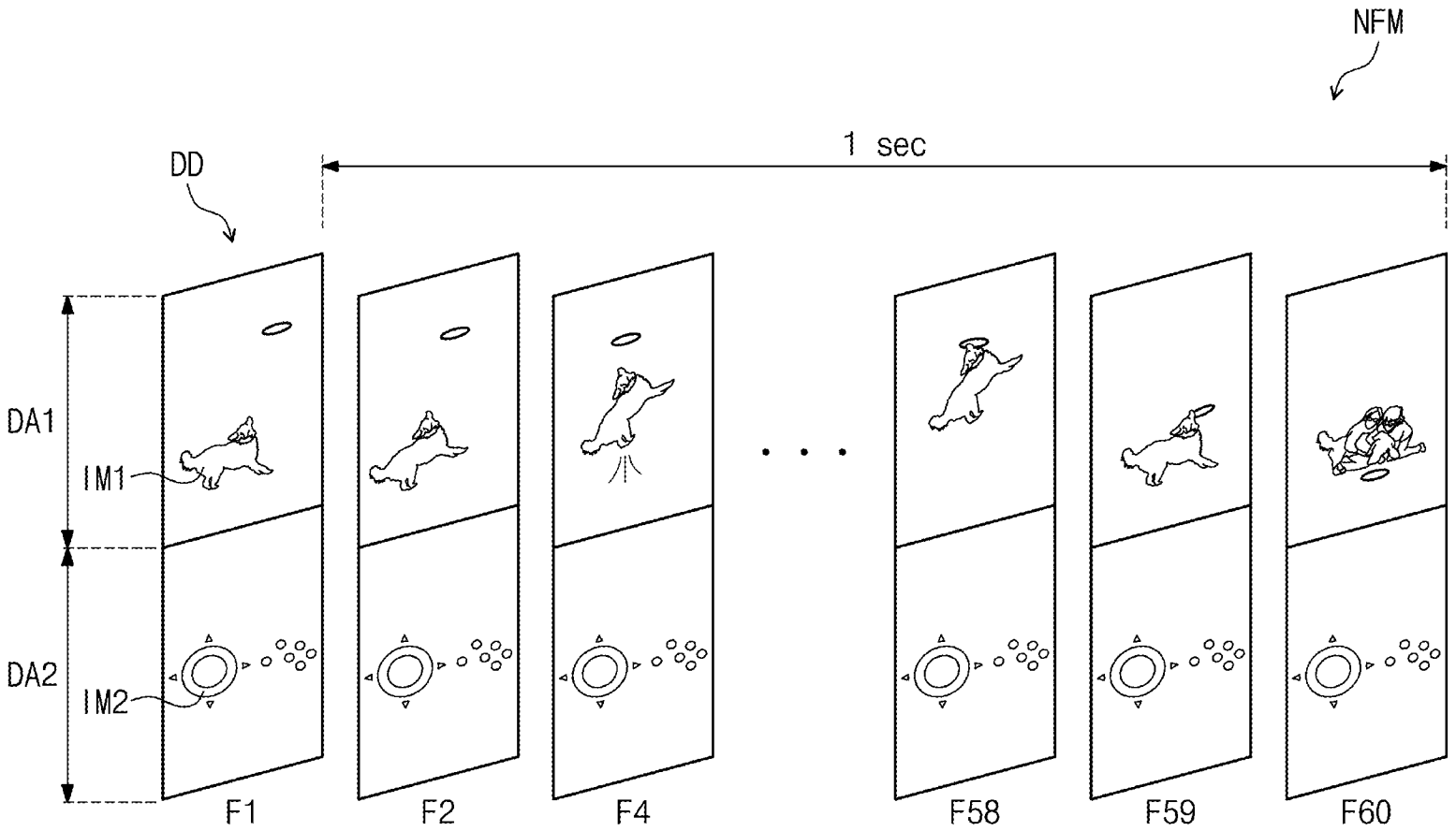
FIG. 2 is a view for describing the operation of a display device in a normal frequency mode.

FIG. 2 is a view for describing the operation of a display device in a normal frequency mode.

First, referring to FIG. 2, both the first image IM1 to be displayed in the first display region DA1 and the second image IM2 to be displayed in the second display region DA2 may be moving images. The first image IM1 to be displayed in the first display region DA1 and the second image IM2 to be displayed in the second display region DA2 illustrated in FIG. 2 are only exemplary. Various images may be displayed in the display device DD.

In a normal frequency mode NFM, the driving frequency of the first display region DA1 and the second display region DA2 of the display device DD is a normal frequency. For example, the normal frequency may be 60 Hertz (Hz). In the normal frequency mode NFM, in the first display region DA1 and the second display region DA2 of the display device DD, images of a first frame F1 to a sixtieth frame F60 may be displayed for one second.

Figure 3A:
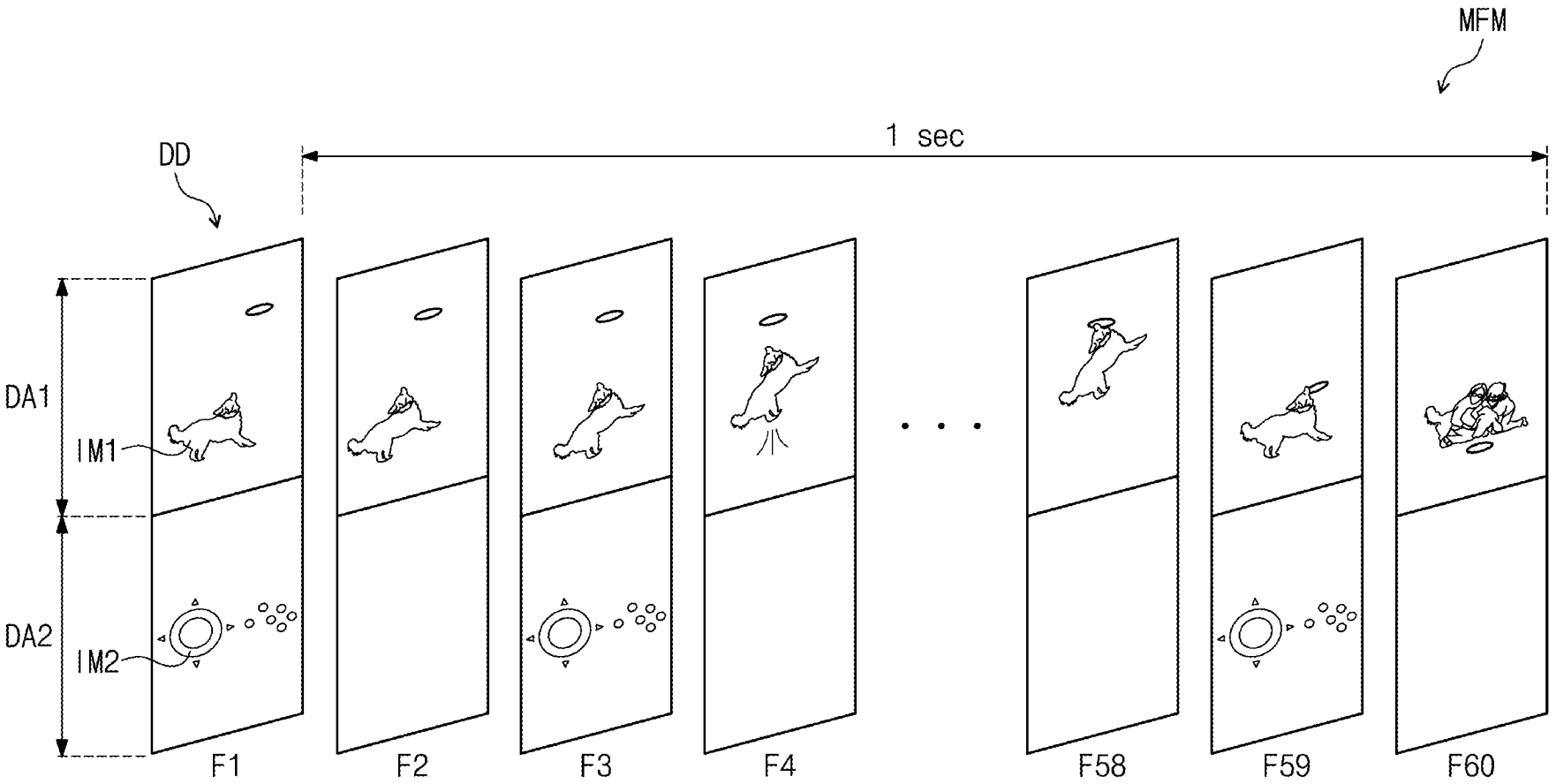
FIG. 3A and FIG. 3B are views for describing the operation of a display device in a multi-frequency mode.
Figure 3B:
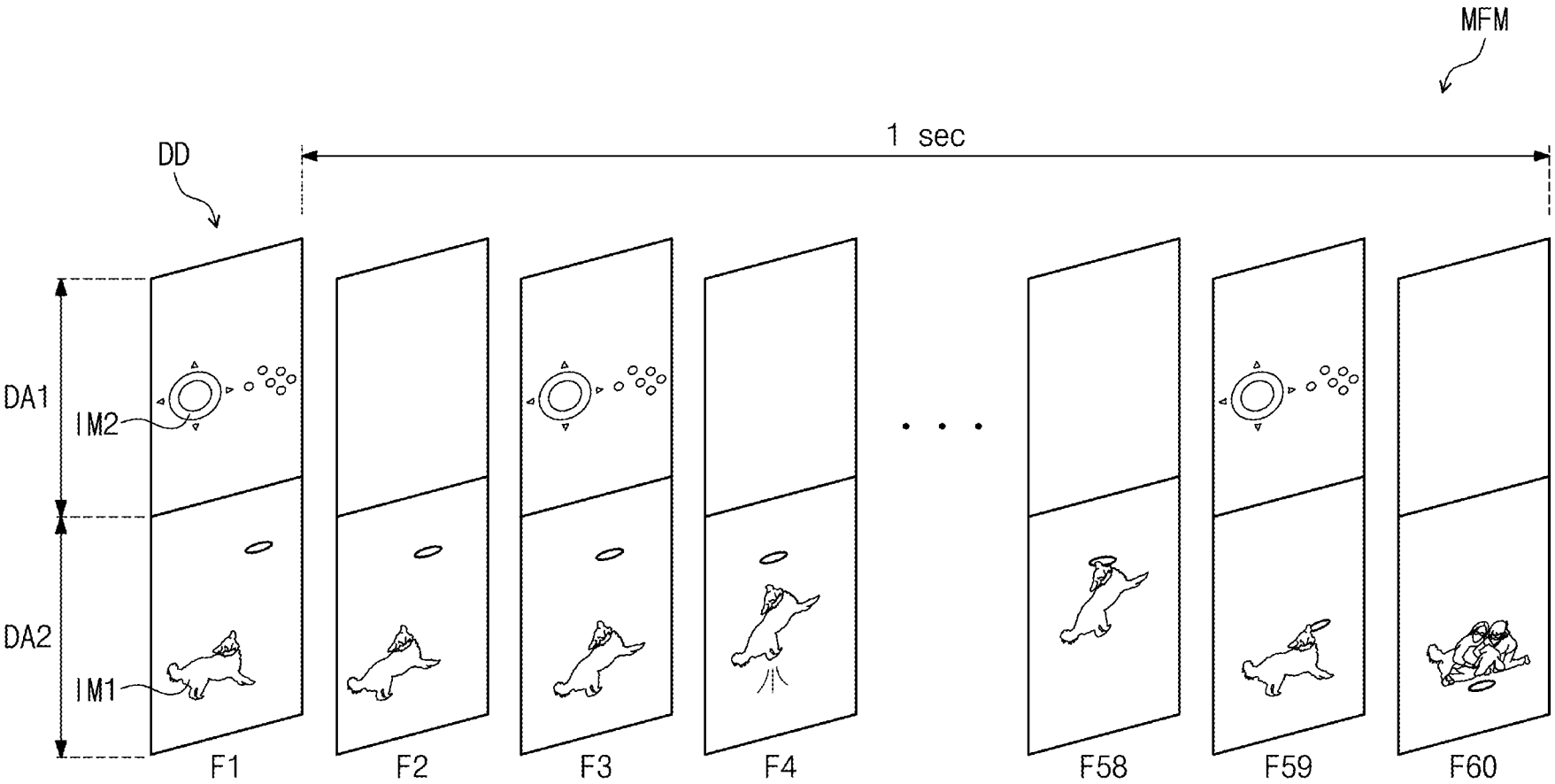

FIG. 3A and FIG. 3B are views for describing the operation of a display device in a multi-frequency mode.

Referring to FIG. 3A, in a multi-frequency mode MFM, the display device DD may set the driving frequency of the first display region DA1 in which the first image IM1, that is a moving image, is displayed to a first driving frequency, and may set the driving frequency of the second display region DA2 in which the second image IM2, that is a still image, is displayed to a second driving frequency which is lower than the first driving frequency. When the normal frequency is 60 Hz, the first driving frequency may be 60 Hz, and the second driving frequency may be 30 Hz.

In an embodiment, for example, as illustrated in FIG. 3A, when the first driving frequency is 60 Hz and the second driving frequency is 30 HZ in the multi-frequency mode MFM, the first image IM1 may be displayed during each of the first frame F1 to the sixtieth frame F60 in the first display region DA1 of the display device DD, and the second image IM2 may be displayed only during odd-numbered frames F1, F3, F5, . . . , F59 in the second display region DA2 thereof for one second. That is, in the multi-frequency mode MFM, the first image IM1 corresponding to 60 frames is displayed in the first display region DA1 and the second image IM2 corresponding to 30 frames is displayed in the second display region DA2 for one second. Since images are not generated for the second display region DA2 during even-numbered frames F2, F4, F6, . . . , F60 of the multi-frequency mode MFM, power consumption may be reduced.

Referring to FIG. 3B, in the multi-frequency mode MFM, the display device DD may set the driving frequency of the first display region DA1 in which the second image IM2, that is a still image, is displayed to a second driving frequency which is lower than a normal frequency, and may set the driving frequency of the second display region DA2 in which the first image IM1, that is a moving image, is displayed to a first driving frequency which is higher than the second driving frequency.

Figure 4:
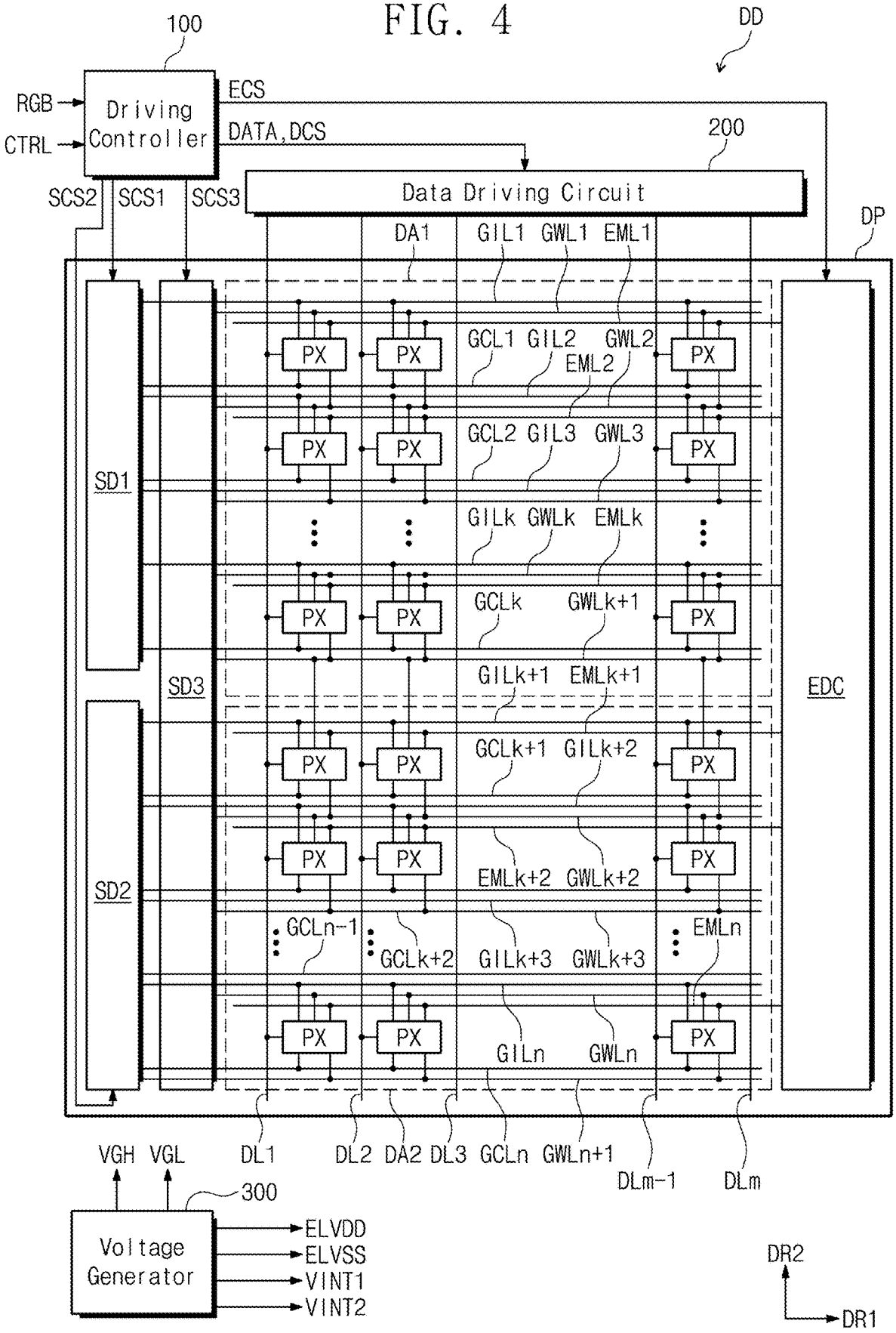
FIG. 4 is a block diagram of a display device according to an embodiment of the inventive concept.

FIG. 4 is a block diagram of a display device according to an embodiment of the inventive concept.

Referring to FIG. 4, the display device DD includes a display panel DP, a driving controller 100, a data driving circuit 200, and a voltage generator 300.

The driving controller 100 receives an image signal RGB and a control signal CTRL. The driving controller 100 generates an image data signal DATA obtained by converting the data format of the image signal RGB to meet the interface specifications of the data driving circuit 200. The driving controller 100 may output a first scan control signal SCS1, a second scan control signal SCS2, a third scan control signal SCS3, a data control signal DCS, and a light emission control signal ECS.

The data driving circuit 200 receives the data control signal DCS and the image data signal DATA from the driving controller 100. The data driving circuit 200 converts the image data signal DATA into data signals and outputs the data signals to a plurality of data lines DL1 to DLm (to be described later). Here, m is a natural number. The data signals are analog voltages corresponding to gray scale values of the image data signal DATA.

The voltage generator 300 generates voltages for the operation of the display panel DP. In this embodiment, the voltage generator 300 generates a first driving voltage ELVDD, a second driving voltage ELVSS, a first initialization voltage VINT1, and a second initial initialization voltage VINT2.

The display panel DP includes first scan lines GIL1 to GILn, second scan lines GCL1 to GCLn, third scan lines GWL1 to GWLn+1, light emission control lines EML1 to EMLn, data lines DL1 to DLm, and pixels PX. Here, n is a natural number). The display panel DP may further include a scan driving circuit and a light emission driving circuit EDC. In an embodiment, the scan driving circuit may include a first scan driving circuit SD1, a second scan driving circuit SD2, and a third scan driving circuit SD3. In an embodiment, the first scan driving circuit SD1, the second scan driving circuit SD2, and the third scan driving circuit SD3 are arranged on a third side surface of the display panel DP (i.e., left side of the display panel DP in FIG. 4), and the light emission driving circuit EDC is arranged on a fourth side surface of the display panel DP (i.e., right side of the display panel DP in FIG. 4). In other words, the first scan driving circuit SD1, the second scan driving circuit SD2, and the third scan driving circuit SD3 may be arranged facing the light emission driving circuit EDC in the first direction DR1 with the pixels PX interposed therebetween.

First scan lines GIL1 to GILk and second scan lines GCL1 to GCLk are extended from the first scan driving circuit SD1 in the first direction DR1. First scan lines GILk+1 to GILn and second scan lines GCLk+1 to GCLn are extended from the second scan driving circuit SD2 in the first direction DR1. Here, k is a natural number less than n. Third scan lines GWL1 to GWLn+1 are extended from the third scan driving circuit SD3 in the first direction DR1. The light emission driving circuits EML1 to EMLn are extended from the emission driving circuit EDC in a direction opposite to the first direction DR1.

The first scan lines GIL1 to GILn, the second scan lines GCL1 to GCLn, the third scan lines GWL1 to GWLn+1, and the light emission control lines EML1 to EMLn are arranged spaced apart from each other in the second direction DR2. The data lines DL1 to DLm are extended from the data driving circuit 200 in a direction opposite to the second direction DR2, and arranged spaced apart from each other in the first direction DR1.

The first scan driving circuit SD1 may correspond to the first display region DA1, and second scan driving circuit SD2 may correspond to the second display region DA2. For example, the pixels PX in the first display region DA1 are connected to the first scan lines GIL1 to GILk, the second scan lines GCL1 to GCLk, third scan lines GWL1 to GWLk+1, and light emission control lines EML1 to EMLk. The pixels PX in the second display region DA2 are connected to the first scan lines GILk+1 to GILn, the second scan lines GCLk+1 to GCLn, third scan lines GWLk+1 to GWLn+1, and light emission control lines EMLk+1 to EMLn.

Each of the plurality of pixels PX is electrically connected to one corresponding first scan line of the first scan lines GIL1 to GILn, one corresponding second scan line of the second scan lines GCL1 to GCLn, two corresponding third scan lines of the third scan lines GWL1 to GWLn+1, one corresponding light emission control line of the light emission control lines EML1 to EMLn, and one corresponding data line of the data lines DL1 to DLm. Each of the plurality of pixels PX may be electrically connected to at least one of the plurality of scan lines.

In an embodiment, for example, pixels in a first row in the first display region DA1 may be connected to scan lines GILL GCL1, GWL1, and GWL2. Pixels in a second row may be connected to scan lines GIL2, GCL2, GWL2, and GWL3. Pixels in a k-th row in the first display region DA1 may be connected to scan lines GILk, GCLk, GWLk, and GWLk+1.

In an embodiment, for example, pixels in a k+1 row in the second display region DA2 may be connected to scan lines GILk+1, GCLk+1, GWLk+1, and GWLk+2. Pixels in an n-th row may be connected to scan lines GILn, GCLn, GWLn, and GWLn+1.

Each of the plurality of pixels PX includes an organic light emitting diode ED (see FIG. 5) and a pixel circuit unit PXC (see FIG. 5) which controls the light emission of a light emitting diode ED. The pixel circuit unit PXC may include a plurality of transistors and a capacitor. At least any one of the first scan driving circuit SD1, the second scan driving circuit SD2, and the third scan driving circuit SD3, and the light emission driving circuit EDC may include transistors formed through the same manufacturing process as a process for forming the pixel circuit unit PXC.

Each of the plurality of pixels PX receives the first driving voltage ELVDD, the second driving voltage ELVSS, the first initialization voltage VINT1, and the second initial initialization voltage VINT2.

The first scan driving circuit SD1 receives the first scan control signal SCS1 from the driving controller 100. The first scan driving circuit SD1 may output first scan signals to the first scan lines GIL1 to GILk and may output second scan signals to the second scan lines GCL1 to GCLk in response to the first scan control signal SCS1.

The second scan driving circuit SD2 receives the second scan control signal SCS2 from the driving controller 100. The second scan driving circuit SD2 may output first scan signals to the first scan lines GILk+1 to GILn and may output second scan signals to the second scan lines GCLk+1 to GCLn in response to the second scan control signal SCS2.

The third scan driving circuit SD3 receives a third scan control signal SCS3 from the driving controller 100. The third scan driving circuit SD3 may output third scan signals to the third scan lines GWL1 to GWLn+1 in response to the third scan control signal SCS3.

The circuit configuration and operation of the first scan driving circuit SD1 and the second scan driving circuit SD2 will be described in detail later.

The light emission driving circuit EDC receives the light emission control signal ECS from the driving controller 100. The light emission driving circuit EDC may output light emission control signals to the light emission control lines EML1 to EMLn in response to the light emission control signal ECS.

In FIG. 4, the first scan driving circuit SD1, the second scan driving circuit SD2, and the third scan driving circuit SD3 are illustrated as being arranged only on a third side of the display panel DP (i.e., left side of the display panel DP in FIG. 4), but the embodiment of the inventive concept is not limited thereto.

The first scan driving circuit SD1 according to an embodiment may drive the first scan lines GIL1 to GILk and the second scan lines GCL1 to GCLk at any one of a normal frequency, a first driving frequency, and a second driving frequency in response to the first scan control signal SCS1.

The second scan driving circuit SD2 according to an embodiment may drive the first scan lines GILk+1 to GILn and the second scan lines GCLk+1 to GCLn at any one of a normal frequency, a first driving frequency, and a second driving frequency in response to the second scan control signal SCS2.

The third scan driving circuit SD3 according to an embodiment may sequentially drive the third scan lines GWL1 to GWLn+1 in response to the third scan control signal SCS3. Although FIG. 4 illustrates "one" third scan driving circuit SD3, as in the case of the first scan driving circuit SD1 and the second scan driving circuit SD2, "two" third scan driving circuits SD3 corresponding to the first display region DA1 and a third scan driving circuit corresponding to the second display region DA2 respectively may be independently configured in another embodiment.

Figure 5:
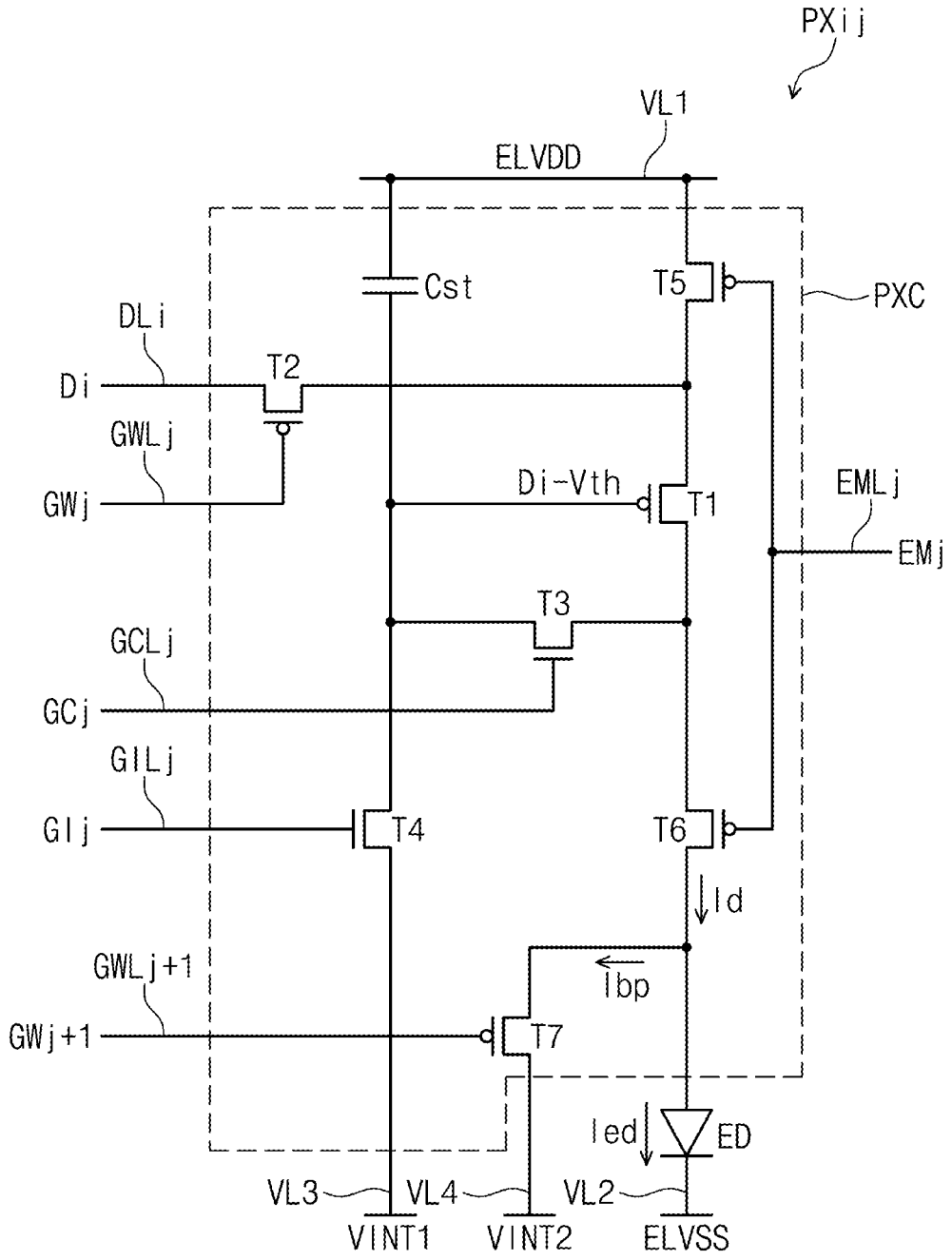
FIG. 5 is an equivalent circuit diagram of a pixel according to an embodiment of the inventive concept.

FIG. 5 is an equivalent circuit diagram of a pixel according to an embodiment of the inventive concept.

FIG. 5 exemplarily illustrates an equivalent circuit diagram of a pixel PXij connected to an j-th data line DLi among the data lines DL1 to DLm, a j-th first scan line GILj among the first scan lines GIL1 to GILn, a j-th second scan line GCLj among the second scan lines GCL1 to GCLn, a j-th third scan line GWLj and a (j+1)-th third scan line GWLj+1 among the third scan lines GWL1 to GWLn+1, and a j-th light emission control line EMLj among the light emission control lines EML1 to EMLn illustrated in FIG. 1. Here, i is a natural number equal to or less than m, and j is a natural number equal to or less than n.

Each of the plurality of pixels PX illustrated in FIG. 5 may have the same circuit configuration as that shown in the equivalent circuit diagram of the pixel PXij illustrated in FIG. 4. In this embodiment, the pixel circuit unit PXC of the pixel PXij includes first to seventh transistors T1 to T7 and one capacitor Cst. Also, each of first, second, fifth, sixth, and seventh transistors may be a P-type transistor having a low-temperature polycrystalline silicon ("LTPS") semiconductor layer, and each of third and fourth transistors T3 and T4 may be an N-type transistor having an oxide semiconductor as a semiconductor layer. However, the embodiment of the inventive concept is not limited thereto. At least one of the first to seventh transistors T1 to T7 may be an N-type transistor and the rest thereof may be a P-type transistor in another embodiment. Also, the circuit configuration of a pixel according to the inventive concept is not limited to what is shown in FIG. 5. The pixel circuit unit PXC illustrated in FIG. 5 is only exemplary, and the configuration of the pixel circuit unit PXC may be modified and implemented.

Referring to FIG. 5, the pixel PXij of the display device according to an embodiment includes the first to seventh transistors T1, T2, T3, T4, T5, T6, and T7, the capacitor Cst, and at least one light emitting diode ED. In this embodiment, one pixel PXij including one light emitting diode ED will be described as an example.

For convenience of explanation, the j-th first scan line GILj, the j-th second scan line GCLj, the j-th third scan line GWLj, the (j+1)-th third scan line GWLj+1, and the j-th light emission control line EMLj are referred to as a first scan line GILj, a second scan line GCLj, a third scan line GWLj, a fourth scan line GWLj+1, and a light emission control line EMLj, respectively.

The first to fourth scan lines GILj, GCLj, GWLj, and GWLj+1 may transmit first to fourth scan signals GIj, GCj, GWj, and GWj+1, respectively. A first scan signal GIj may turn on/turn off a fourth transistor T4 which is an N-type transistor. A second scan signal GCj may turn on/turn off a third transistor T3 which is an N-type transistor. A third scan signal GWj may turn on/turn off a second transistor T2 which is a P-type transistor. A fourth scan signal GWj+1 may turn on/turn off a seventh transistor T7 which is a P-type transistor.

The light emission control line EMLj may transmit a light emission control signal EMj capable of controlling the light emission of the light emitting diode ED included in the pixel PXij. The light emission control signal EMj transmitted by the light emission control line EMLj may have a different waveform from the scan signals GIj, GCj, GWj, and GWj+1 transmitted by the first to fourth scan lines GILj, GCLj, GWLj, GWLj+1. The data line DLi transmits a data signal Di. The data signal Di may have a voltage level corresponding to the image signal RGB input to the driving controller 100 (see FIG. 4). First to fourth driving voltage lines VL1, VL2, VL3, and VL4 may transmit the first driving voltage ELVDD, the second driving voltage ELVSS, the first initialization voltage VINT1, and the second initialization voltage VINT2, respectively. The first initialization voltage VINT1 and the second initialization voltage VINT2 may have different voltage levels. In another embodiment, the first initialization voltage VINT1 and the second initialization voltage VINT2 may have the same voltage level.

A first transistor T1 includes a first electrode connected to the first driving voltage line VL1 via a fifth transistor T5, a second electrode electrically connected to an anode of the light emitting diode ED via a sixth transistor T6, and a gate electrode connected to one end of the capacitor Cst. The first transistor T1 may receive the data signal Di transmitted by the data line DLi in accordance with the switching operation of the second transistor T2 and supply a driving current Id to the light emitting diode ED.

The second transistor T2 includes a first electrode connected to the data line DLi, a second electrode connected to the first electrode of the first transistor T1, and a gate electrode connected to the third scan line GWLj. The second transistor T2 may be turned on according to the third scan signal GWj received through the third scan line GWLj to transmit the data signal Di transmitted from the data line DLi to the first electrode of the first transistor T1.

The third transistor T3 includes a first electrode connected to the gate electrode of the first transistor T1, a second electrode connected to the second electrode of the first transistor T1, and a gate electrode connected to the second scan line GCLj. The third transistor T3 may be turned on according to the second scan signal GCj received through the second scan line GCLj to connect the gate electrode and the second electrode of the first transistor T1 so as to diode connect the first transistor T1.

The fourth transistor T4 includes a first electrode connected to the gate electrode of the first transistor T1, a second electrode connected to a third driving voltage line VL3 through which the first initialization voltage VINT1 is transmitted, and a gate electrode connected to the first scan line GILj. The fourth transistor T4 may be turned on according to the first scan signal GIj received through the first scan line GILj to transmit the first initialization voltage VINT1 to the gate electrode of the first transistor T1 so as to perform an initialization operation for initializing the voltage of the gate electrode of the first transistor T1.

The fifth transistor T5 includes a first electrode connected to the first driving voltage line VL1, a second electrode connected to the first electrode of the first transistor T1, and a gate electrode connected to the light emission control line EMLj.

The sixth transistor T6 includes a first electrode connected to the second electrode of the first transistor T1, a second electrode connected the anode of the light emitting diode ED, and the gate electrode connected to the light emission control line EMLj.

The fifth transistor T5 and the sixth transistor T6 are simultaneously turned on according to the light emission control signal EMj received through the light emission control line EMLj, so that the first driving voltage ELVDD may be compensated through the diode-connected first transistor T1 to be transmitted to the light emitting diode ED.

The seventh transistor T7 includes a first electrode connected to a fourth driving voltage line VL4, a second electrode connected to a second electrode of the sixth transistor T6, and the gate electrode connected to the fourth scan line GWLj+1. In another embodiment, the first electrode of the seventh transistor T7 may be connected to the third driving voltage line VL3 instead of the fourth driving voltage line VL4.

The one end of the capacitor Cst is connected to the gate electrode of the first transistor T1 as described above, and the other end of the capacitor Cst is connected to the first driving voltage line VL1. A cathode of the light emitting diode ED may be connected to a second driving power line VL2 for transmitting the second driving voltage ELVSS. The structure of the pixel PXij according to an embodiment is not limited to the structure illustrated in FIG. 5. The number of transistors and the number of capacitors included in one pixel PXij and the connection relationship therebetween may be variously modified.

Figure 6:
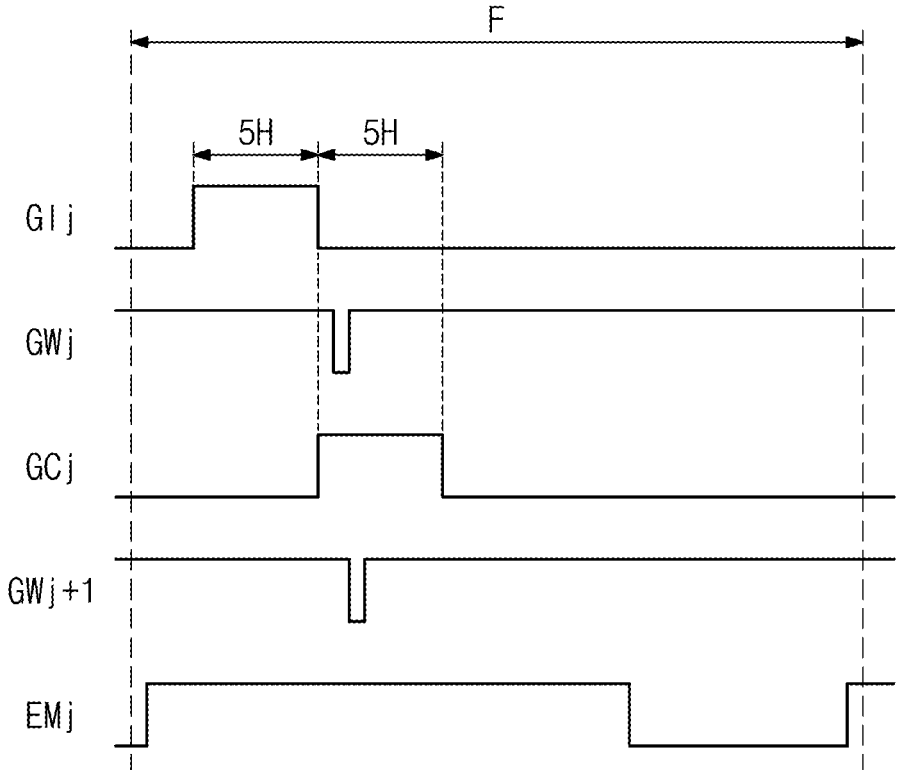
FIG. 6 is a timing diagram for describing the operation of a pixel of the display device of FIG. 3.

FIG. 6 is a timing diagram for describing the operation of the pixel of FIG. 5. Referring to FIG. 5 and FIG. 6, the operation of a display device according to an embodiment will be described.

Referring FIG. 5 and FIG. 6, during an initialization period within one frame F, the first scan signal GIj of a high level is supplied through the first scan lines GILj. In response to the first scan signal GIj of a high level, the fourth transistor T4 is turned on, and through the fourth transistor T4, the first initialization voltage VINT1 is transmitted to the gate electrode of the first transistor T1 to initialize the first transistor T1.

Next, when the second scan signal GCj of a high level is supplied through the second scan line GCLj during data programming and a compensation period, the third transistor T3 is turned on. The first transistor T1 is diode-connected by the turned-on third transistor T3, and is biased in a forward direction. The pulse width of each of the first scan signal GIj and the second scan signal GCj may be five horizontal sections 5 H. A horizontal section H is time during which the pixels PX in one row in the first direction DR1 of the display panel DP (see FIG. 2) are driven.

When the third scan signal GWj of a low level is supplied through the third scan line GWLj, the second transistor T2 is turned on. Then, a compensation voltage Di-Vth which amounts to a reduced voltage by a threshold voltage Vth of the first transistor T1 from the data signal Di is applied to the gate electrode of the first transistor T1. That is, a gate voltage applied to the gate electrode of the first transistor T1 may be the compensation voltage Di-Vth.

To both ends of the capacitor Cst, the first driving voltage ELVDD and the compensation voltage Di-Vth are applied, respectively, and in the capacitor Cst, electric charges corresponding to the voltage difference between the both ends may be stored.

The seventh transistor T7 is turned on by being supplied with the fourth scan signal GWj+1 of a low level through the fourth scan line GWLj+1. Some amount (i.e., bypass current Ibp) of the driving current Id may exit through the seventh transistor T7 to the fourth driving voltage line VL4.

If the light emitting diode ED emits light even when a minimum current of the first transistor T1 for displaying a black image flows as a driving current, the black image is not properly displayed. Accordingly, the seventh transistor T7 in the pixel PXij according to an embodiment of the inventive concept may disperse a portion of the minimum current of the first transistor T1 as the bypass current Ibp into a current path other than a current bath on the side of an organic light emitting diode. Here, the minimum current of the first transistor T1 refers to a current under a condition that the first transistor is turned off since a gate-source voltage of the first transistor T1 is less than the threshold voltage Vth. As such, the minimum driving current under the condition that the first transistor T1 is turned off (for example, a current of 10 picoamperes (pA) or less) is transmitted to the light emitting diode and displayed as an image of black luminance. When the minimum driving current for displaying the black image flows, the effect of the bypass transmission of the bypass current Ibp is significant. However, when a large driving current for displaying an image, such as a normal image or a white image, flows, there is little effect of the bypass current Ibp. Accordingly, when a driving current for displaying a black image flows, a light emitting current Ied of the light emitting diode ED reduced by the amount of current of the bypass current Ibp exiting through the seventh transistor T7 from the driving current Id may have a minimum amount of current to a level so as to reliably display the black image. Accordingly, an image of correct black luminance may be implemented using the seventh transistor T7, so that the contrast ratio may be improved. In this embodiment, a bypass signal is the fourth scan signal GWj+1 of a low level, but the embodiment of the inventive concept is not necessarily limited thereto.

Next, the light emission control signal EMj supplied from the light emission control line EMLj during a light emitting period is changed from a high level to a low level. During the light emitting period, the fifth transistor T5 and the sixth transistor T6 are turned on by the light emission control signal EMj of a low level. Then, the driving current Id corresponding to the voltage difference between the gate voltage of the gate electrode of the first transistor T1 and the first driving voltage ELVDD is generated, and through the sixth transistor T6, the driving current Id is supplied to the light emitting diode ED such that the current Ied flows in the light emitting diode ED. During the light emitting period, the gate-source voltage of the first transistor T1 is maintained as amount of '(Di-Vth)-ELVDD' by the capacitor Cst, and according to the current-voltage relationship of the first transistor T1, the driving current Id may be proportional to '$(Di\text{-}ELVDD)^2$,' the square of a value obtained by subtracting the threshold voltage Vth from a driving gate-source voltage. Accordingly, the driving current Id may be determined regardless of the threshold voltage Vth of the first transistor T1.

Figure 7:
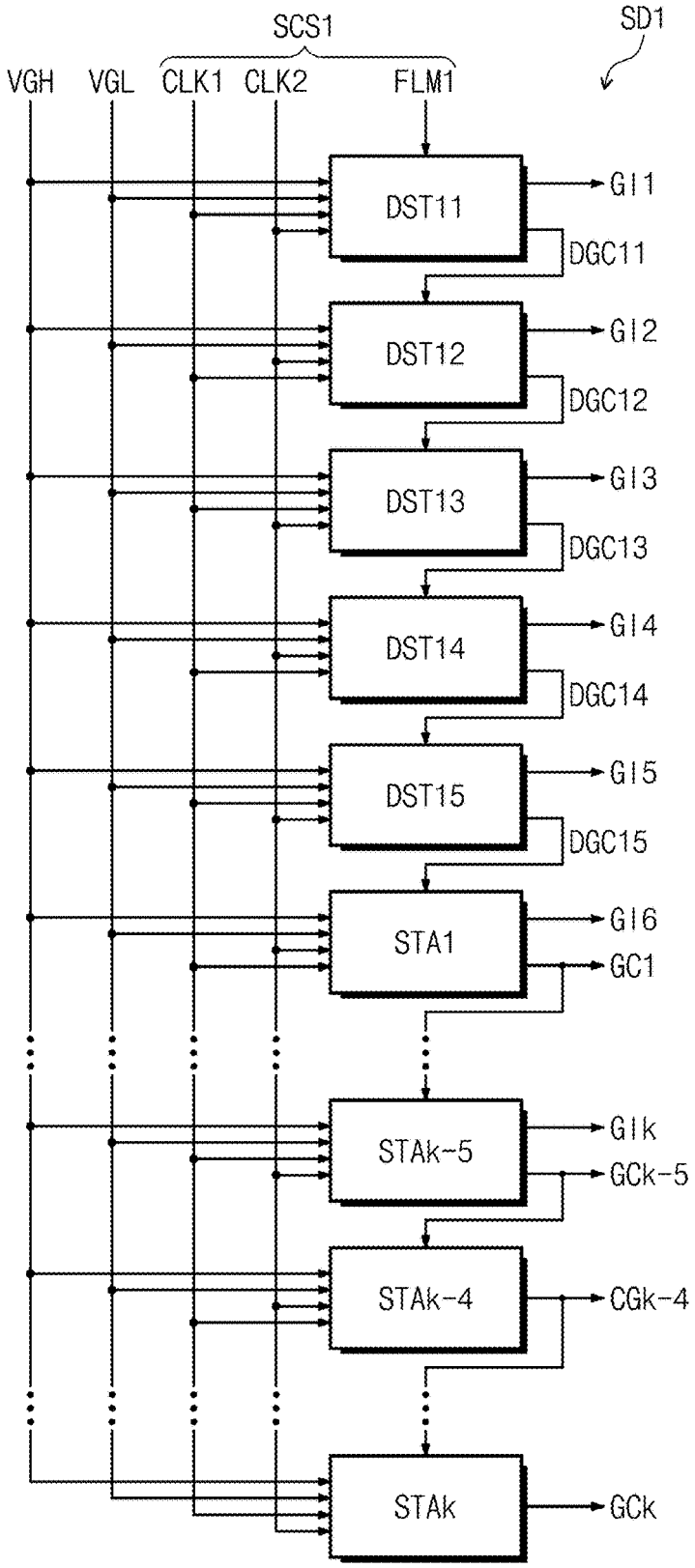
FIG. 7 is a block diagram of a first scan driving circuit according to an embodiment of the inventive concept.

FIG. 7 is a block diagram of the first scan driving circuit SD1 according to an embodiment of the inventive concept.

Referring to FIG. 7, the first scan driving circuit SD1 includes first dummy driving stages DST11 to DST15 and first driving stages STA1 to STAk.

Each of the first driving stages STA1 to STAk receives the first scan control signal SCS1 from the driving controller 100 illustrated in FIG. 4. The first scan control signal SCS1 includes a first start signal FLM1, a first clock signal CLK1, and a second clock signal CLK2. Each of the first driving stages STA1 to STAk receives a first voltage VGL and a second voltage VGH. The first voltage VGL and the second voltage VGH may be provided from the voltage generator 300 illustrated in FIG. 4.

In an embodiment, the first dummy driving stages DST11 to DST15 output first scan signals GI1 to GI5 and dummy-second scan signals DGC11 to DGC15, respectively. First driving stages STA1 to STAk−5 output first scan signals GI6 to GIk and second scan signals GC1 to GCk−5, respectively. First driving stages STA1*k*−4 to STAk output second scan signals GCk−4 to GCk, respectively.

First scan signals GI1 to GIk may be provided to the first scan lines GIL1 to GILk, respectively, illustrated in FIG. 4, and second scan signals GC1 to GCk may be provided to the second scan lines GCL1 to GCLk, respectively, illustrated in FIG. 4.

A first dummy driving stage DST11 may receive the first start signal FLM1 as a first carry signal. Each of first dummy driving stages DST12 to DST15 may receive a dummy-second scan signal output from a previous driving stage as a carry signal. A first driving stage STA1 may receive a dummy-second scan signal DGC15 output from a first dummy driving stage DST15 as a carry signal. Each of first driving stages STA2 to STAk may receive a second scan signal output from a previous driving stage as a carry signal.

Figure 8:
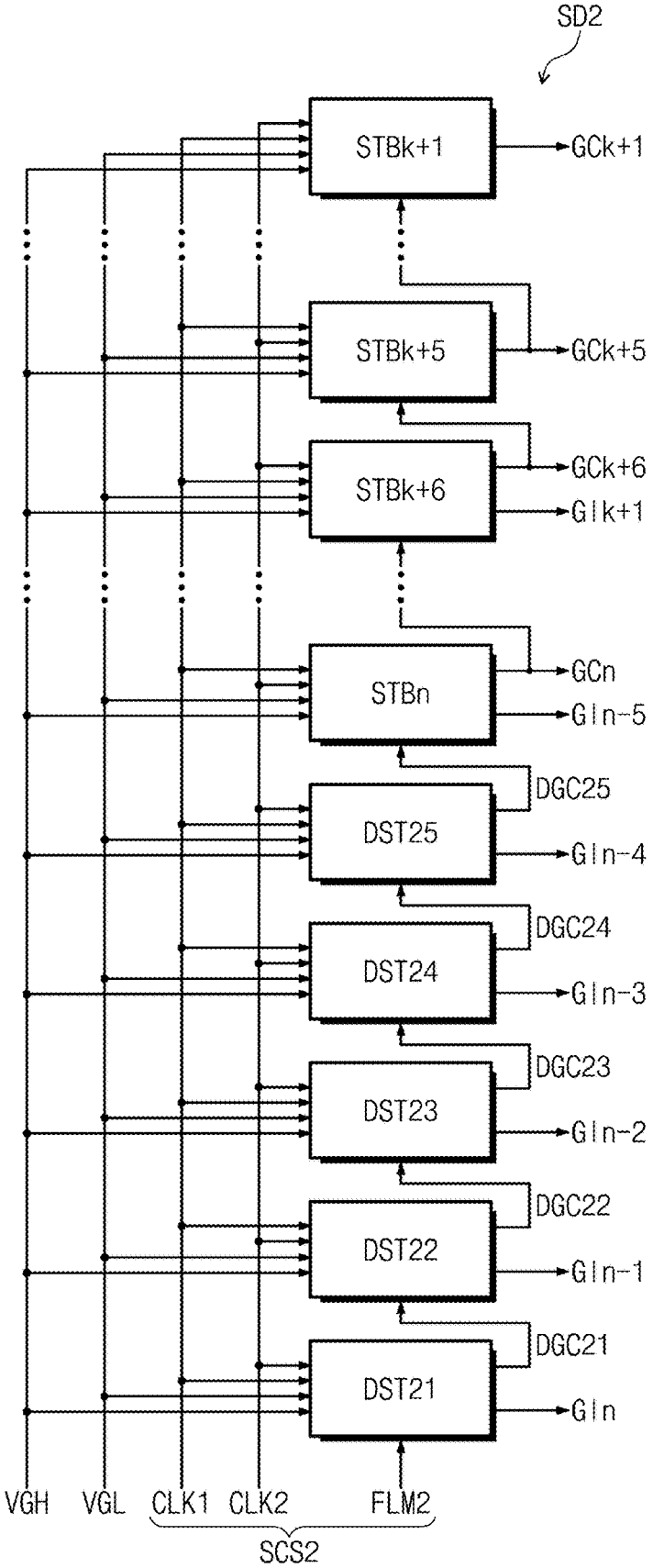
FIG. 8 is a block diagram of a second scan driving circuit according to an embodiment of the inventive concept.

FIG. 8 is a block diagram of the second scan driving circuit SD2 according to an embodiment of the inventive concept.

Referring to FIG. 8, the second scan driving circuit SD2 includes second dummy driving stages DST21 to DST25 and second driving stages STBk+1 to STBn.

Each of the second driving stages STBk+1 to STBn receives the second scan control signal SCS2 from the driving controller 100 illustrated in FIG. 2. The second scan control signal SCS2 includes a second start signal FLM2, the first clock signal CLK1, and the second clock signal CLK2. Each of the second driving stages STBk+1 to STBn receives the first voltage VGL and the second voltage VGH. The first voltage VGL and the second voltage VGH may be provided from the voltage generator 300 illustrated in FIG. 4. In an embodiment, the first clock signal CLK1, the second clock signal CLK2, the first voltage VGL, and the second voltage VGH provided to the first dummy driving stages DST11 to DST15 and the first driving stages STA1 to STAk illustrated in FIG. 7 may be the same as the first clock signal CLK1, the second clock signal CLK2, the first voltage VGL, and the second voltage VGH provided to the second dummy driving stages DST21 to DST25 and the second driving stages STBk+1 to STBn.

In an embodiment, the second dummy driving stages DST21 to DST25 may output first scan signals GIn to GIn−4 and dummy-second scan signals DGC21 to DGC25, respectively. Second driving stages STBk+6 to STBn output first scan signals GIk+1 to GIn−5 and second scan signals GCk+6 to GCn, respectively. Second driving stages STBk+1 to STBk+5 output second scan signals GCk+1 to GCk+5, respectively.

First scan signals GIk+1 to GIn may be provided to the first scan lines GILk+1 to GILn, respectively, illustrated in FIG. 4, and second scan signals GCk+1 to GCn may be provided to the second scan lines GCLk+1 to GCLn, respectively, illustrated in FIG. 4.

A second dummy driving stage DST21 may receive the second start signal FLM2 as a first carry signal. Each of second dummy driving stages DST22 to DST25 may receive a dummy-second scan signal output from a previous driving stage as a carry signal. A second driving stage STBn may receive a dummy-second scan signal DGC25 output from a second dummy driving stage DST25 as a carry signal. Each of second driving stages STBn−1 to STBk+6 may receive a second scan signal output from a previous driving stage as a carry signal.

Figure 9:
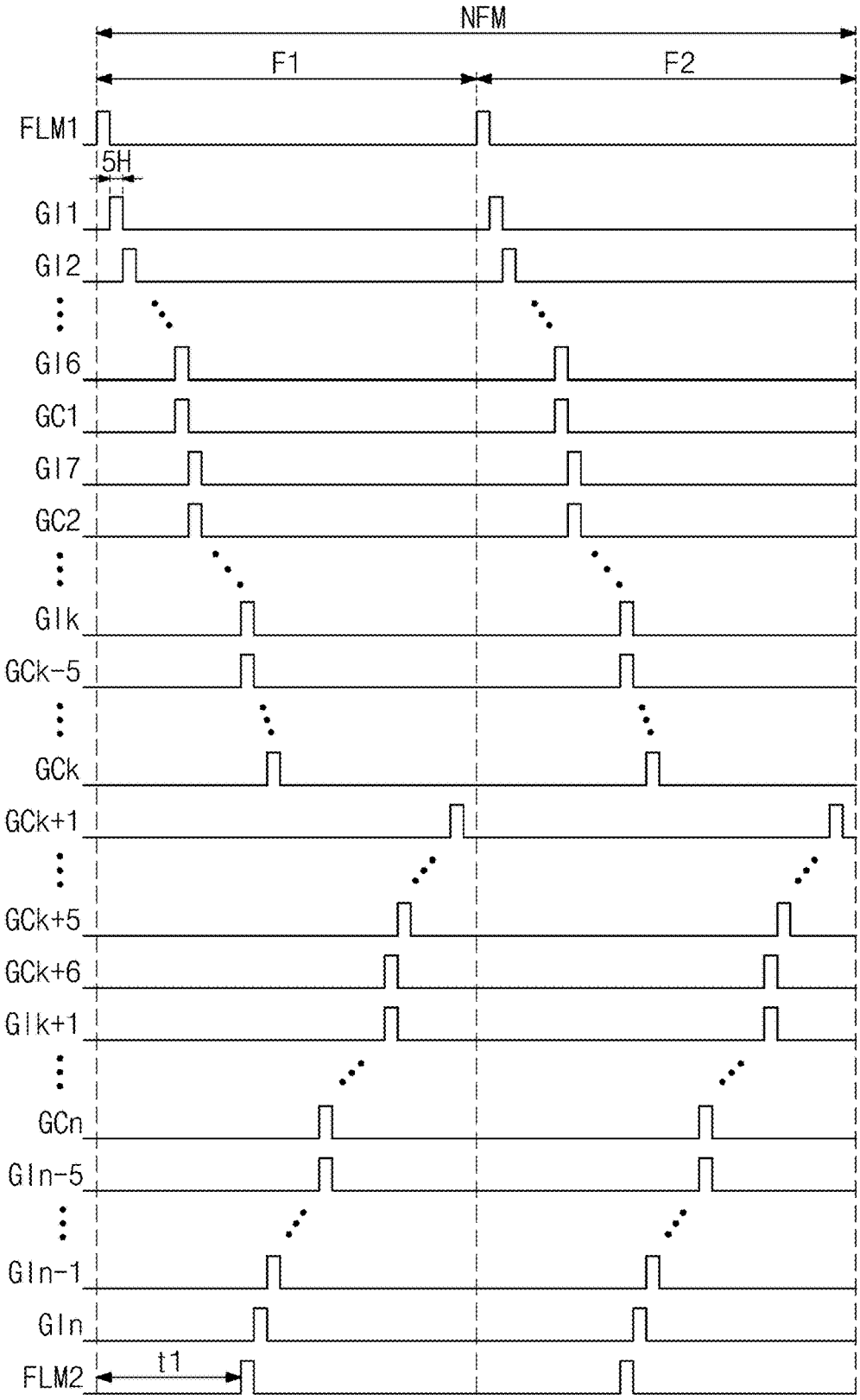
FIG. 9 is a view exemplarily showing first scan signals and second scan signals respectively output from the first scan driving circuit illustrated in FIG. 7 and the second scan driving circuit illustrated in FIG. 8 in a normal frequency mode.

FIG. 9 is a view exemplarily showing first scan signals GI1 to GIn and second scan signals GC1 to GCn output from the first scan driving circuit SD1, respectively, illustrated in FIG. 7 and the second scan driving circuit SD2 illustrated in FIG. 8 in a normal frequency mode.

Referring to FIG. 7, FIG. 8, and FIG. 9, in the normal frequency mode NFM, the first scan driving circuit SD1 may sequentially activate the first scan signals GI1 to GIk to a high level and may sequentially activate the second scan signals GC1 to GCk to a high level in synchronization with the first start signal FLM1, the first clock signal CLK1, and the second clock signal CLK2.

In the normal frequency mode NFM, the second scan driving circuit SD2 may sequentially activate first scan signals GIn to GIk+1 to a high level and may sequentially activate the second scan signals GCn to GCk+1 to a high level in synchronization with the second start signal FLM2, the first clock signal CLK1, and the second clock signal CLK2.

The second start signal FLM2 may be activated to a high level after the first start signal FLM1 is activated to a high level and then a first delay time t1 elapses. The first delay time t1 may be determined depending on the start position of the second display region DA2, that is, the position of a (k+1)-th first scan line GILk+1.

During each of the first frame F1 and second frame F2 of the normal frequency mode NFM, first scan signals GI1 to GIk and GIn to GIk+1 may be sequentially activated to a high level and the second scan signals GC1 to GCk and GCn to GCk+1 may be sequentially activated. Therefore, as illustrated in FIG. 2, during each of the first frame F1 and the second frame F2, the first image IM may be displayed in the first display region DA1 and the second image IM may be displayed in the second display region DA2.

Figure 10:
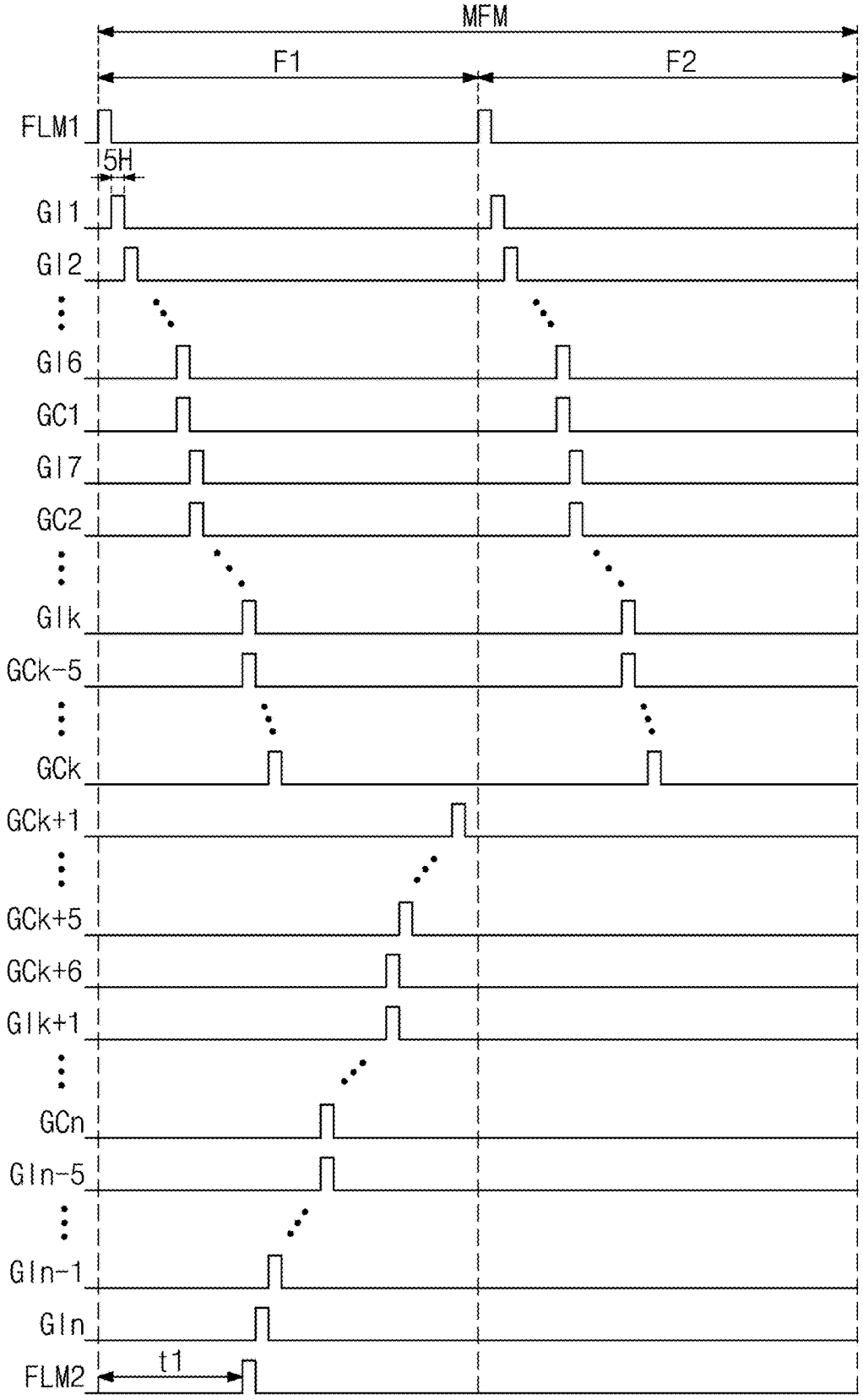
FIG. 10 is a view exemplarily showing first scan signals and second scan signals respectively output from the first scan driving circuit illustrated in FIG. 7 and the second scan driving circuit illustrated in FIG. 8 in a multi-frequency mode.

FIG. 10 is a view exemplarily showing the first scan signals GI1 to GIn and the second scan signals GC1 to GCn output from the first scan driving circuit SD1, respectively, illustrated in FIG. 7 and the second scan driving circuit SD2 illustrated in FIG. 8 in a multi-frequency mode.

Referring to FIG. 7, FIG. 8, and FIG. 10, in the multi-frequency mode MFM, the first scan driving circuit SD1 may sequentially activate the first scan signals GI1 to GIk to a high level and may sequentially activate the second scan signals GC1 to GCk to a high level in synchronization with the first start signal FLM1, the first clock signal CLK1, and the second clock signal CLK2.

In the multi-frequency mode MFM, the second scan driving circuit SD2 may sequentially activate first scan signals GIn to GIk+1 to a high level and may sequentially activate the second scan signals GCn to GCk+1 to a high level in synchronization with the second start signal FLM2, the first clock signal CLK1, and the second clock signal CLK2.

The second start signal FLM2 may be activated to a high level after the first start signal FLM1 is activated to a high level and then the first delay time t1 elapses. The first delay time t1 may be determined depending on the start position of the second display region DA2, that is, the position of a (k+1)-th first scan line GILk+1.

During the first frame F1 of the multi-frequency mode MFM, first scan signals GI1 to GIk and GIn to GIk+1 may be sequentially activated to a high level and the second scan signals GC1 to GCk and GCn to GCk+1 may be sequentially activated.

During the second frame F2 of the multi-frequency mode MFM, the first start signal FLM1 may be activated to a high level, and the second start signal FLM2 may not be activated to a high level. In this case, During the second frame F2, the first scan signals GI1 to GIk and the second scan signals GC1 to GCk are sequentially activated, but the first scan signals GIn to GIk+1 and the second scan signals GCn to GCk+1 are maintained to a low level. As the first scan signals GIn to GIk+1 and the second scan signals GCn to GCk+1 are maintained to a low level, pixels arranged in the second display region DA2 do not display images. Since the second scan driving circuit SD2 and the pixels in the second display region DA2 do not operated during the second frame F2, power consumption may be reduced.

As illustrated in FIG. 9 and FIG. 10, the pulse width of each of the first scan signals GI1 to GIn and the second scan signals GC1 to GCn may be five horizontal sections 5 H. For example, as illustrated in FIG. 6, the j-th second scan signal GCj may be activated to a high level after the j-th first scan signal GIj is activated to a high level and then the five horizontal sections 5 H elapse.

In a case that a delay of five horizontal sections 5 H is used between the j-th first scan signal GIj and the j-th second scan signal GCj, as illustrated in FIG. 7 and FIG. 8, five first dummy driving stages DST11 to DST15 and five second dummy driving stages DST21 to DST25 are required.

The first dummy driving stages DST11 to DST15 may be disposed on a first side surface of the display panel DP (e.g., upper side of the display panel DP in FIG. 4), and the second dummy driving stages DST21 to DST25 may be disposed on a second side surface of the display panel DP (e.g., lower side of the display panel DP in FIG. 4). In other words, the first dummy driving stages DST11 to DST15 may be disposed facing the second dummy driving stages DST21 to DST25 with the first dummy driving stages STA1 to STAk and the second driving stages STBk+1 to STBn interposed therebetween in the second direction DR2. If the second dummy driving stages DST21 to DST25 are disposed between the first display region DA1 and the second display region DA2, there may be a dead space in the folding region FA.

In an embodiment of the inventive concept, by disposing the second dummy driving stages DST21 to DST25 on one side of the second display region DA2 (e.g., lower side of the second display region DA2 FIG. 1A), it is possible to minimize the dead space shown in the middle of the display region DA.

FIG. 6, FIG. 7, FIG. 8, FIG. 9, and FIG. 10 illustrate that the pulse width of each of the first scan signals GI1 to GIn and the second scan signals GC1 to GCn is five horizontal sections 5 H. However, the embodiment of the inventive concept is not limited thereto. In another embodiment, for example, the pulse width of each of the first scan signals GI1 to GIn and the second scan signals GC1 to GCn may be a w horizontal section w-H or more (wherein, w is a natural number). In addition, the number of first dummy driving stages and the number of second dummy driving stages may vary according to the pulse width of each of the first scan signals GI1 to GIn and the second scan signals GC1 to GCn.

Figure 11:
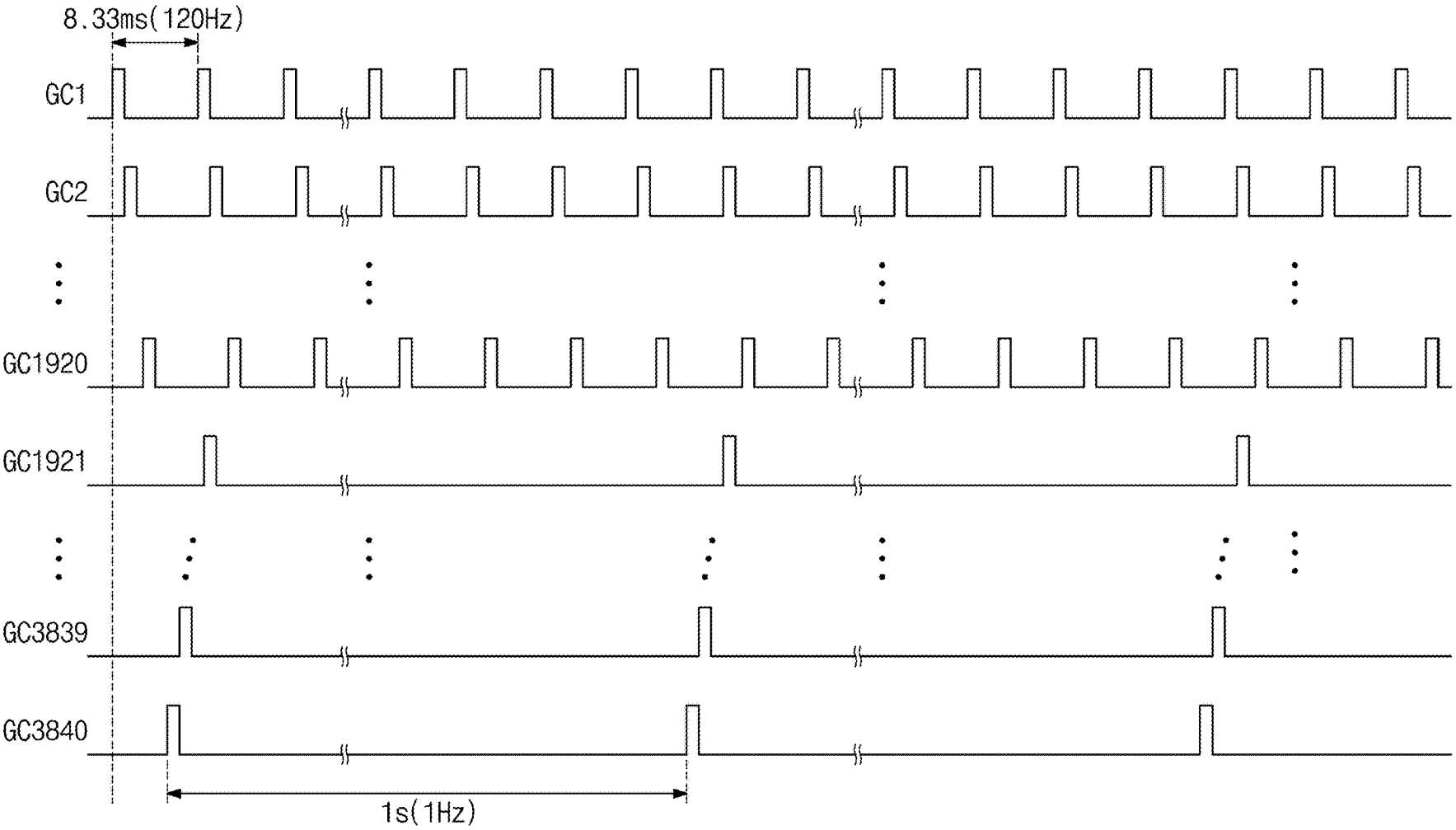
FIG. 11 is a signal timing diagram exemplarily illustrating second scan signals in a multi-frequency mode.

FIG. 11 is a signal timing diagram exemplarily illustrating second scan signals in a multi-frequency mode.

FIG. 11 exemplarily shows 3840 second scan signals GC1 to GC3840 when the display device DD (see FIG. 4) includes 3840 second scan lines GCL1 to GCL3840. That is, the number of the second scan lines is 3840.

The first display region DA1 (see FIG. 4) may correspond to second scan lines GCL1 to GCL1920 and the second display region DA2 (see FIG. 4) may correspond to second scan lines GCL1921 to GCL3840.

In the multi-frequency mode MFM, when the second scan lines GCL1 to GCL1920 corresponding to the first display region DA1 are driven at 120 Hz, the cycle of the second scan lines GCL1 to GCL1920 is 8.33 milliseconds (ms).

In the multi-frequency mode MFM, when the second scan lines GCL1921 to GCL3840 corresponding to the second display region DA2 are driven at 1 Hz, the cycle of the second scan lines GCL1921 to GCL3840 is 1 second (s).

Figure 12:
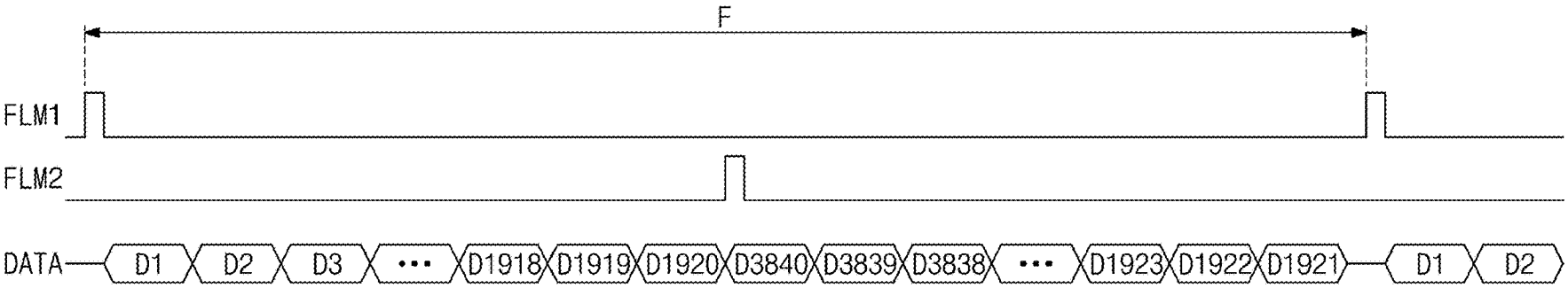
FIG. 12 is a signal timing diagram exemplarily illustrating an image data signal output from a driving controller in a normal frequency mode.

FIG. 12 is a signal timing diagram exemplarily illustrating the image data signal DATA output from a driving controller in a normal frequency mode.

Referring to FIG. 4 and FIG. 12, the driving controller 100 provides the image data signal DATA to the data driving circuit 200. During a predetermined frame F of the normal frequency mode NFM, the driving controller 100 may sequentially provide data signals D1 to D1920 and D3840 to D1921 to the data driving circuit 200. Each of the data signals D1 to D1920 and D3840 to D1921 is a signal provided to data lines connected to the pixels PX in one row. For example, a data signal D1 is a signal provided to the data lines DL1 to DLm connected to the pixels PX in the first row. A data signal D1921 is a signal provided to the data lines DL1 to DLm connected to the pixels PX in the 1921$^{st}$ row.

As illustrated in FIG. 11, since the second scan lines GCL1 to GCL1920 are sequentially driven and then the second scan lines GCL3840 to GCL1921 are sequentially driven, the driving controller 100 may sequentially provide data signals D1 to D1920 to the data driving circuit 200 and then may sequentially provide data signals D3840 to D1921 to the data driving circuit 200.

Figure 13:
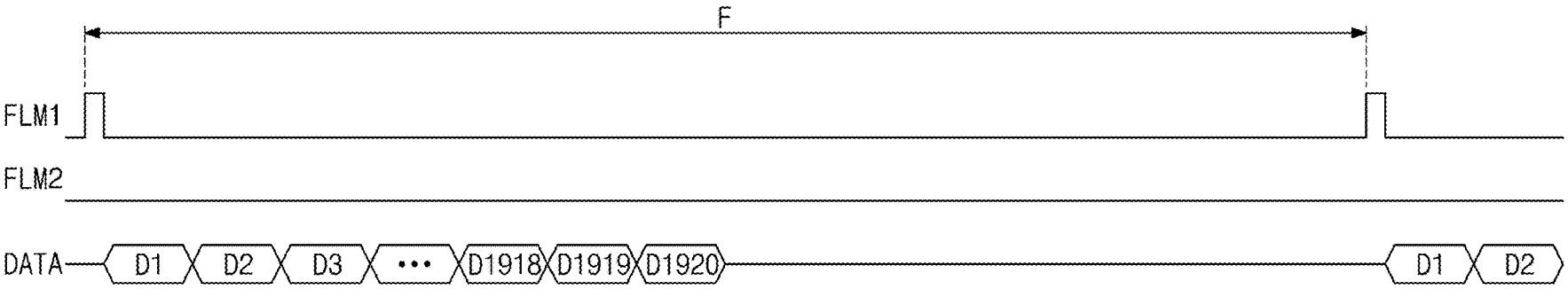
FIG. 13 is a signal timing diagram exemplarily illustrating an image data signal output from a driving controller in a multi-frequency mode.

FIG. 13 is a signal timing diagram exemplarily illustrating the image data signal DATA output from a driving controller in a multi-frequency mode.

Referring to FIG. 10 and FIG. 13, since the second scan lines GCL1 to GCL1920 are sequentially driven during a predetermined frame F of the multi-frequency mode MFM, the driving controller 100 may sequentially provide the data signals D1 to D1920 to the data driving circuit 200. The predetermined frame F of the multi-frequency mode MFM may be the second frame F2 illustrated in FIG. 10.

Since the second scan lines GCL1921 to GCL3840 are maintained to a low level during the second frame F2 of the multi-frequency mode MFM, the driving controller 100 does not provide any data signal to the data driving circuit 200.

Figure 14A:
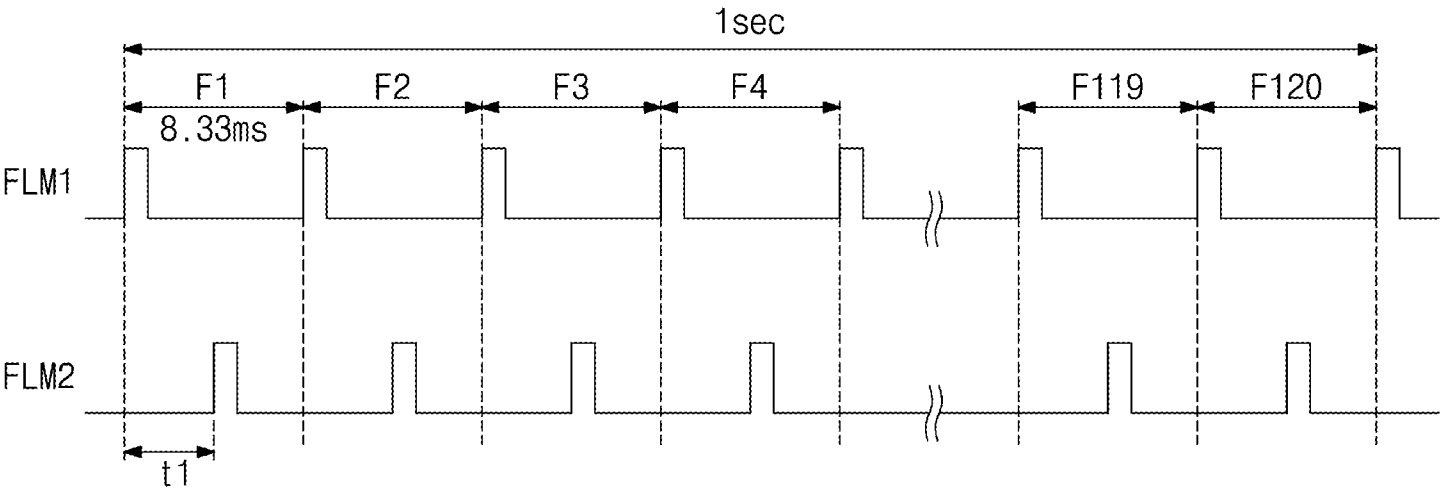
FIG. 14A is a signal timing diagram exemplarily illustrating a first start signal and a second start signal in a normal frequency mode.
Figure 14B:
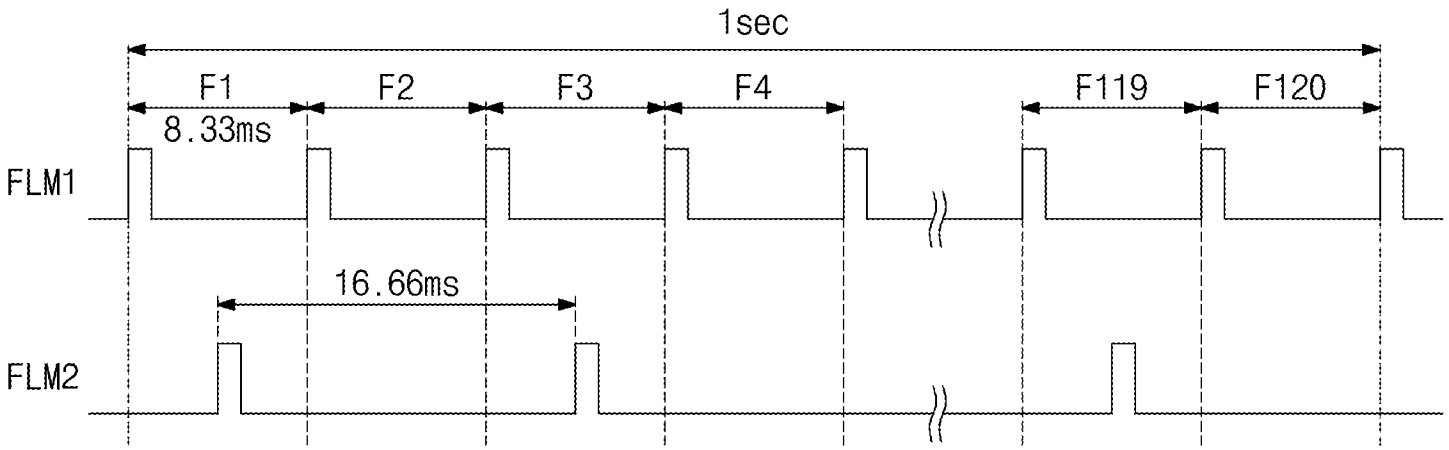
FIG. 14B to FIG. 14D are signal timing diagrams exemplarily illustrating a first start signal and a second start signal in a multi-frequency mode.
Figure 14C:
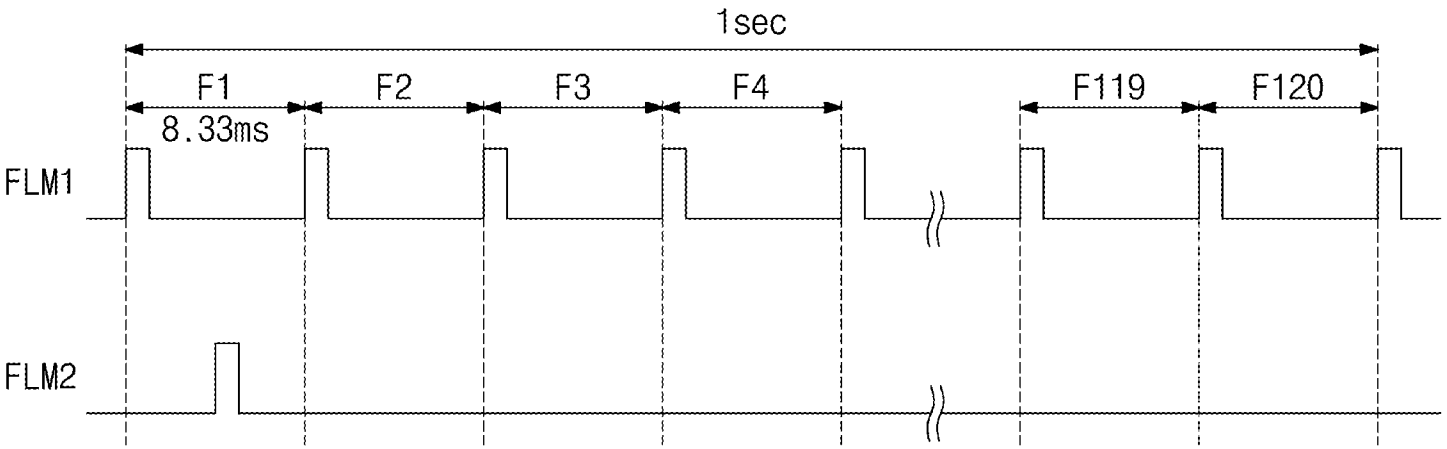
Figure 14D:
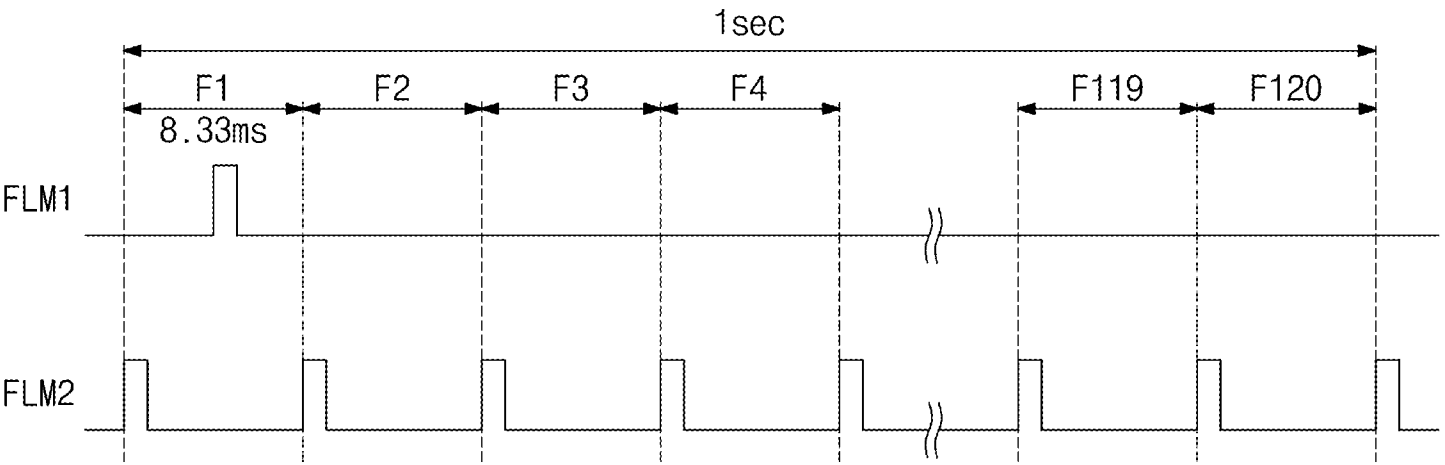

FIG. 14A is a signal timing diagram exemplarily illustrating a first start signal and a second start signal in a normal frequency mode. FIG. 14B to 14D are signal timing diagrams exemplarily illustrating a first start signal and a second start signal in a multi-frequency mode.

First, referring to FIG. 4 and FIG. 14A, the display device DD may drive the first display region DA1 and the second display region DA2 at a first driving frequency in the normal frequency mode NFM. The first driving frequency may be 120 Hz.

In the normal frequency mode NFM, each of the first start signal FLM1 and the second start signal FLM2 is 120 Hz, and one cycle is 8.33 ms. The second start signal FLM2 may be activated to a high level after the first start signal FLM1 is activated to a high level and then the first delay time t1 elapses.

Referring to FIG. 4 and FIG. 14B, the display device DD may drive the first display region DA1 at a first driving frequency and may drive the second display region DA2 at a second driving frequency in the multi-frequency mode MFM. The first driving frequency may be 120 Hz, and the second driving frequency may be 60 Hz.

In the multi-frequency mode MFM, the first driving frequency of the first start signal FLM1 is 120 Hz, and one cycle is 8.33 ms. In the multi-frequency mode MFM, the second driving frequency of the second start signal FLM2 is 60 Hz, and one cycle is 16.66 ms. That is, the first start signal FLM1 may be activated to a high level every frame. The second start signal FLM2 may be activated to a high level during odd-numbered frames F1, F3, F5, . . . , F119, and may be maintained to a low level during even-numbered frames F2, F4, F6, . . . , F120.

Referring to FIG. 4 and FIG. 14C, the display device DD may drive the first display region DA1 at a first driving frequency and may drive the second display region DA2 at a second driving frequency in the multi-frequency mode MFM. The first driving frequency may be 120 Hz, and the second driving frequency may be 1 Hz.

In the multi-frequency mode MFM, the first driving frequency of the first start signal FLM1 is 120 Hz, and one cycle is 8.33 ms. In the multi-frequency mode MFM, the second driving frequency of the second start signal FLM2 is 1 Hz, and one cycle is 1 second (s). That is, the first start signal FLM1 may be activated to a high level every frame. The second start signal FLM2 may be activated to a high level during the first frame F1, and may be maintained to a low level during the rest of the frames F2 to F120.

As the second driving frequency of the second start signal FLM2 corresponding to the second display region DA2 is lowered in the multi-frequency mode MFM, the power consumption of the display device DD may be further reduced.

Referring to FIG. 4 and FIG. 14D, the display device DD may drive the first display region DA1 at a second driving frequency and may drive the second display region DA2 at a first driving frequency in the multi-frequency mode MFM. The first driving frequency may be 120 Hz, and the second driving frequency may be 1 Hz.

In the multi-frequency mode MFM, the second driving frequency of the first start signal FLM1 is 1 Hz, and one cycle is 1 second (s). In the multi-frequency mode MFM, the first driving frequency of the second start signal FLM2 is 120 Hz, and one cycle is 8.33 ms. That is, the second start signal FLM2 may be activated to a high level every frame. The first start signal FLM1 may be activated to a high level during the first frame F1, and may be maintained to a low level during the rest of the frames F2 to F120.

When a moving image is displayed in a first display region and a still image is displayed in a second display region, a display device having the above configuration may lower the driving frequency of the second display region than that of the first display region, thereby reducing power consumption. Particularly, a first scan driving circuit which drives the first display region and a second scan driving circuit which drives the second display region are independently provided, so that the operation of any one of the first scan driving circuit and the second scan driving circuit may be stopped.

Although the inventive concept has been described with reference embodiments of the inventive concept, it will be understood by those skilled in the art that various modifications and changes in form and details may be made therein without departing from the spirit and scope of the inventive concept as set forth in the following claims. In addition, the embodiments disclosed in the inventive concept are not intended to limit the technical spirit of the inventive concept, and all technical concepts falling within the scope of the following claims and equivalents thereof are to be construed as being included in the scope of the inventive concept.

What is claimed is:

1. A display device comprising:

a display panel in which a first display region and a second display region are defined and including a plurality of pixels each connected to one of a plurality of data lines and at least one of a plurality of scan lines;

a data driving circuit which drives the plurality of data lines;

a scan driving circuit which drives the plurality of scan lines; and a driving controller which receives an image signal and a control signal and control the data driving circuit and the scan driving circuit according to an operation mode, wherein the driving controller provides a first start signal and a second start signal corresponding to the operation mode to the scan driving circuit, and the scan driving circuit comprises:

a first scan driving circuit including first dummy driving stages and first driving stages which sequentially drive scan lines corresponding to the first display region among the plurality of scan lines in synchronization with the first start signal; and a second scan driving circuit including second dummy driving stages and second driving stages which sequentially drive scan lines corresponding to the second display region among the plurality of scan lines in synchronization with the second start signal, wherein the first dummy driving stages are disposed on a first side surface of the display panel and the second dummy driving stages are disposed on a second side surface of the display panel.

2. The display device of claim 1, wherein the plurality of scan lines comprises first to n-th first scan lines, the first display region corresponds to from the first first scan line to the k-th first scan line among the plurality of scan lines, the second display region corresponds to from the (k+1)-th first scan line to the n-th first scan line among the plurality of scan lines, and n is a natural number and k is a natural number less than n.

3. The display device of claim 2, wherein the first scan driving circuit sequentially drives from the first first scan line to the k-th first scan line, and the second scan driving circuit sequentially drives from the n-th first scan line to the (k+1)-th first scan line.

4. The display device of claim 2, wherein the plurality of scan lines further comprises first to n-th second scan lines, the first dummy driving stages include first to w-th first dummy driving stages, the first to w-th first dummy driving stages sequentially drive from the first first scan line to the w-th first scan line, respectively, w is a natural number less than k, and the first driving stages include first to k-th first driving stages, the first to (k−w)-th first driving stages sequentially drive from the (w+1)-th first scan line to the k-th first scan line, respectively, and the first to k-th first driving stages sequentially drive from the first second scan line to the k-th second scan line, respectively.

5. The display device of claim 4, wherein each of the first dummy driving stages and the first to (k−w)-th first driving stages outputs a first scan signal and a dummy-second scan signal in response to a clock signal and a carry signal received from the driving controller.

6. The display device of claim 5, wherein the dummy-second scan signal output from the j-th first dummy driving stage is provided as the carry signal of the (j+1)-th first dummy driving stage, j is a natural number, and the second scan signal output from the j-th first driving stage is provided as the carry signal of the (j+1)-th first driving stage.

7. The display device of claim 6, wherein the first first dummy driving stage receives the first start signal as the carry signal, and the first first driving stage receives the dummy-second scan signal from the w-th first dummy driving stage as the carry signal.

8. The display device of claim 4, wherein the second dummy driving stages include first to w-th second dummy driving stages, the first to w-th second dummy driving stages sequentially drive from the n-th first scan line to the (n−w−1)-th first scan line, respectively and the second driving stages include (k+1)-th to n-th second driving stages, the n-th to (k+w+1)-th second driving stages sequentially drive from the (n−w)-th first scan line to the (k+1)-th first scan line, respectively, and the n-th to (k+1)-th second driving stages sequentially drive from the n-th second scan line to the (k+1)-th second scan line, respectively.

9. The display device of claim 8, wherein each of the second dummy driving stages and the n-th to (k+w+1)-th second driving stages outputs a first scan signal and a dummy-second scan signal in response to a clock signal and a carry signal received from the driving controller.

10. The display device of claim 9, wherein the dummy-second scan signal output from the j-th second dummy driving stage is provided as the carry signal of the (j+1)-th second dummy driving stage, j is a natural number, and the second scan signal output from the j-th second driving stage is provided as the carry signal of the (j−1)-th second driving stage.

11. The display device of claim 10, wherein the first second dummy driving stage receives the second start signal as the carry signal, and the n-th second driving stage receives the dummy-second scan signal from the w-th second dummy driving stage as the carry signal.

12. The display device of claim 3, wherein the driving controller provides an image data signal corresponding to the first display region and the second display region to the data driving circuit in every frame when the operation mode is a normal frequency mode, and the driving controller provides an image data signal corresponding to the first display region and the second display region to the data driving circuit during a first frame, and provides an image data signal corresponding to the first display region, not the second display region, to the data driving circuit during a second frame when the operation mode is a multi-frequency mode.

13. The display device of claim 12, wherein the driving controller sequentially provides from a data signal corresponding to the first first scan line to a data signal corresponding to the k-th first scan line to the data driving circuit as the image data signal, and sequentially provides from a data signal corresponding to the n-th first scan line to a data signal corresponding to the (k+1)-th first scan line to the data driving circuit as the image data signal when the operation mode is the normal frequency mode.

14. The display device of claim 1, wherein a frequency of each of the first start signal and the second start signal is a first driving frequency when the operation mode is a normal frequency mode, and the frequency of the first start signal is the first driving frequency and the frequency of the second start signal is a second driving frequency which is lower than the first driving frequency when the operation mode is a multi-frequency mode.

15. A display device comprising:

a display panel in which a first non-folding region, a folding region, and a second non-folding region are defined in a plan view and including a plurality of pixels each connected to one of a plurality of data lines and at least one of a plurality of scan lines;

a data driving circuit which drives the plurality of data lines;

a scan driving circuit which drives the plurality of scan lines; and a driving controller which receives an image signal and a control signal and control the data driving circuit and the scan driving circuit according to an operation mode, wherein the driving controller provides a first start signal and a second start signal corresponding to the operation mode to the scan driving circuit, and the scan driving circuit comprises:

a first scan driving circuit including first dummy driving stages and first driving stages which sequentially drive scan lines corresponding to a first display region among the plurality of scan lines in synchronization with the first start signal; and a second scan driving circuit including second dummy driving stages and second driving stages which sequentially drive scan lines corresponding to a second display region among the plurality of scan lines in synchronization with the second start signal, wherein the first dummy driving stages are disposed on a first side surface of the display panel and the second dummy driving stages are disposed on a second side surface of the display panel.

16. The display device of claim 15, wherein the first non-folding region corresponds to the first display region, the second non-folding regions corresponds to the second display region, and a first portion of the folding region corresponds to the first display region and a second portion of the folding region corresponds to the second display region.

17. The display device of claim 15, wherein the plurality of scan lines comprises first to n-th first scan lines, the first display region corresponds to from the first first scan line to the k-th first scan line among the plurality of scan lines, the second display region corresponds to from the (k+1)-th first scan line to the n-th first scan line among the plurality of scan lines, and n is a natural number and k is a natural number less than n.

18. The display device of claim 17, wherein the first scan driving circuit sequentially drives from the first first scan line to the k-th first scan line, and the second scan driving circuit sequentially drives from the n-th first scan line to the (k+1)-th first scan line.

19. The display device of claim 17, wherein the plurality of scan lines further comprises first to n-th second scan lines, the first dummy driving stages include first to w-th first dummy driving stages, the first to w-th first dummy driving stages sequentially drive from the first first scan line to the w-th first scan line, respectively, w is a natural number less than k, and the first driving stages include first to k-th first driving stages, the first to (k−w)-th first driving stages sequentially drive from a (w+1)-th first scan line to a k-th first scan line, respectively, and the first to k-th first driving stages sequentially drive from the first second scan line to the k-th second scan line, respectively.

20. The display device of claim 19, wherein each of the second dummy driving stages sequentially drives from an n-th first scan line to a (n−w−1)-th first scan line, and each of the second driving stages sequentially drives from a (n−w)-th first scan line to a (k+1)-th first scan line and sequentially drives from an n-th second scan line to a (k+1)-th second scan line.

* * * * *